US007610972B2

(12) United States Patent
Adams et al.

(10) Patent No.: US 7,610,972 B2
(45) Date of Patent: Nov. 3, 2009

(54) MOTORIZED TRANSPORTATION APPARATUS AND METHOD

(75) Inventors: Roger R. Adams, Hickory Creek, TX (US); Patrick F. Hamner, Dallas, TX (US)

(73) Assignee: Heeling Sports Limited, Carrollton, TX (US)

( * ) Notice: Subject to any disclaimer, the term of this patent is extended or adjusted under 35 U.S.C. 154(b) by 448 days.

(21) Appl. No.: 11/198,673

(22) Filed: Aug. 4, 2005

(65) Prior Publication Data

US 2006/0027409 A1 Feb. 9, 2006

Related U.S. Application Data

(60) Provisional application No. 60/599,043, filed on Aug. 4, 2004.

(51) Int. Cl.

| | |
|---|---|
| ***B60K 1/00*** | (2006.01) |
| ***A63C 17/12*** | (2006.01) |
| ***A63C 17/04*** | (2006.01) |
| ***A63C 17/00*** | (2006.01) |

(52) U.S. Cl. ..... 180/65.1; 180/65.5; 180/180; 180/181; 280/11.23; 280/11.19; 280/809

(58) Field of Classification Search ..... 180/65.1, 180/65.5, 180, 181; 280/11.23, 11.19, 809
See application file for complete search history.

(56) References Cited

U.S. PATENT DOCUMENTS

| | | | |
|---|---|---|---|
| 132,474 | A | 10/1872 | Lindley |
| 202,191 | A | 4/1878 | Proctor |

(Continued)

FOREIGN PATENT DOCUMENTS

| | | |
|---|---|---|
| AU | DES. 137579 | 6/1999 |

(Continued)

OTHER PUBLICATIONS

Article in "Bulletin Board," Digital bytes and buzz, which contains an ad for "Street Flyers" 1 page.

(Continued)

*Primary Examiner*—Christopher P Ellis
*Assistant Examiner*—John R Olszewski
(74) *Attorney, Agent, or Firm*—Robert J. Ward; Gardere Wynne Sewell LLP

(57) ABSTRACT

An exemplary motorized personal transportation apparatus is provided that may include a motorized heeling apparatus, a motorized heel bracket or a motorized wheel assembly. The motorized heeling apparatus may include a heeling apparatus and an electric motor mounted adjacent the heeling apparatus to impart forward rotation to at least one wheel adjacent the heel of a footwear to allow walking/running on forefoot, and transition to passive rolling and then electric powered rolling.

The motorized heel bracket may include a heel support structure, which may be incorporated in footwear, for supporting at least a portion of the user's heel, wheel(s) mounted adjacent the heel bracket, and an electric motor positioned adjacent the heel support structure and operable to impart forward rotation to the wheel(s).

The motorized wheel assembly includes an electric motor with a wheel around the motor such that the casing or external housing rotates to impart rotation to the wheel assembly. The wheel assembly may be used in virtually any transportation apparatus moving platforms, and footwear.

7 Claims, 19 Drawing Sheets

U.S. PATENT DOCUMENTS

| | | | | |
|---|---|---|---|---|
| 234,030 | A | 11/1880 | Hadley et al. | |
| 487,779 | A | 12/1892 | Schoen | |
| 508,617 | A | 11/1893 | Hoerle | |
| 579,577 | A | 3/1897 | Hanscom | |
| 702,476 | A | 6/1902 | Price | |
| 875,560 | A | 12/1907 | Vaughan | |
| 881,079 | A | 3/1908 | Jolitz | |
| 892,152 | A | 6/1908 | Harman | |
| 966,821 | A | 8/1910 | Gaw | |
| 968,020 | A | 8/1910 | Yandoll | |
| 1,051,880 | A | 2/1913 | Glenn | |
| 1,056,091 | A | 3/1913 | Dickson | |
| 1,068,575 | A | 7/1913 | Demorey et al. | |
| 1,154,370 | A | 9/1915 | Burke | 280/9 |
| 1,189,329 | A | 7/1916 | Winagle | |
| 1,260,901 | A | 3/1918 | Hayhurst | |
| 1,369,849 | A | 3/1921 | Spencer | |
| 1,428,232 | A | 9/1922 | Holmen | |
| 1,468,682 | A | 9/1923 | Wallace | 280/11 |
| 1,502,087 | A | 7/1924 | Bunns | |
| 1,592,692 | A | 7/1926 | Hackett | |
| 1,600,075 | A | 9/1926 | Stoops | |
| 1,608,368 | A | 11/1926 | Bugg | 280/11.19 |
| 1,636,909 | A | 7/1927 | Haney | |
| 1,690,696 | A | 11/1928 | Norwood | |
| 1,702,591 | A | 2/1929 | Brown | |
| 1,751,942 | A | 3/1930 | Nanz | |
| 1,866,006 | A | 7/1932 | Bergstrand | |
| 1,888,617 | A | 11/1932 | Bridi | |
| 1,975,661 | A | 10/1934 | Powell | 208/181 |
| 1,984,989 | A | 12/1934 | Reed | 36/8.3 |
| 1,998,624 | A | 4/1935 | Hughes | 36/35 |
| 2,060,391 | A | 11/1936 | Castagnola | 36/71 |
| 2,095,942 | A | 10/1937 | Wetterstrand | 36/2.5 |
| 2,113,477 | A | 4/1938 | Gilman | 36/8.3 |
| 2,114,461 | A | 4/1938 | Agosta et al. | 36/8.3 |
| 2,114,790 | A | 4/1938 | Venables | 272/57 |
| 2,138,823 | A | 12/1938 | Werkman | 36/76 |
| 2,165,581 | A | 7/1939 | Schroeder | 36/8.3 |
| D117,918 | S | 12/1939 | Brodick | |
| D146,368 | S | 2/1947 | McCaffrey | D34/14 |
| 2,422,228 | A | 6/1947 | Ferrar | 280/11.19 |
| 2,466,611 | A | 4/1949 | Nicoletti | 36/36 |
| 2,476,806 | A | 7/1949 | Brandt, Jr. | 36/76 |
| 2,484,935 | A | 10/1949 | De Rooy | 36/72 |
| 2,490,469 | A | 12/1949 | Pittman | 36/76 |
| D161,557 | S | 1/1951 | Walker et al. | D34/14 |
| 2,572,671 | A | 10/1951 | Shaw | 36/8.3 |
| 2,582,551 | A | 1/1952 | Malherbe | 36/36 |
| 2,632,964 | A | 3/1953 | Kriegel | 36/37 |
| 2,669,038 | A | 2/1954 | De Werth | 36/38 |
| 2,721,400 | A | 10/1955 | Israel | 36/8.5 |
| 2,723,467 | A | 11/1955 | Cassidy | 36/8.3 |
| 2,897,609 | A | 8/1959 | Bodkin | 36/1 |
| 3,010,732 | A | 11/1961 | Correll | 280/11.24 |
| 3,027,661 | A | 4/1962 | McCord | 36/30 |
| 3,032,894 | A | 5/1962 | Kennedy et al. | 36/1 |
| 3,112,119 | A | 11/1963 | Sweet | 280/11.2 |
| 3,176,416 | A | 4/1965 | Seegert | 36/7.1 |
| 3,281,971 | A | 11/1966 | Weitzner | 36/100 |
| 3,306,623 | A | 2/1967 | Weitzner | 280/11.2 |
| 3,351,353 | A | 11/1967 | Weitzner | 280/7.13 |
| 3,374,002 | A | 3/1968 | Lewis | 280/11.24 |
| 3,476,399 | A | 11/1969 | Finn | 280/11.25 |
| 3,478,447 | A | 11/1969 | Gillead | 36/36 |
| 3,486,250 | A | 12/1969 | Purtle | 36/72 |
| 3,665,621 | A | 5/1972 | Massella | 36/37 |
| 3,789,523 | A | 2/1974 | Rubin | 36/2.5 AH |
| D231,999 | S | 7/1974 | Engman | D34/14 C |
| D233,619 | S | 11/1974 | Kelling | D21/2 |
| 3,876,032 | A * | 4/1975 | Ferino | 180/181 |
| 3,876,217 | A | 4/1975 | Copier | 280/11.23 |
| 3,884,485 | A | 5/1975 | Wälle | 280/11.1 R |
| 3,934,359 | A | 1/1976 | Fletcher | 36/73 |
| 3,963,251 | A | 6/1976 | Miano | 280/11.1 BR |
| 3,979,842 | A | 9/1976 | Texidor | 36/115 |
| 3,983,643 | A | 10/1976 | Schreyer et al. | 36/115 |
| 3,997,179 | A | 12/1976 | de Blois | 280/11.24 |
| 4,076,263 | A | 2/1978 | Rand | 280/843 |
| 4,088,334 | A | 5/1978 | Johnson | 280/11.2 |
| 4,095,817 | A | 6/1978 | Cohen | 280/87.04 A |
| D250,492 | S | 12/1978 | Kish | D34/15 AJ |
| 4,133,548 | A | 1/1979 | Smith | 280/87.04 R |
| 4,138,127 | A | 2/1979 | Kimmell et al. | 280/11.23 |
| 4,149,735 | A | 4/1979 | Blackburn et al. | 280/87.04 A |
| 4,150,497 | A | 4/1979 | Weber | 35/11 R |
| 4,183,547 | A | 1/1980 | Cohen et al. | 280/87.04 A |
| 4,214,384 | A | 7/1980 | Gonzalez R. | 36/42 |
| 4,219,240 | A | 8/1980 | Brandenstein et al. | 301/5.7 |
| 4,223,457 | A | 9/1980 | Borgeas | 36/35 B |
| 4,245,406 | A | 1/1981 | Landay et al. | 36/14 |
| 4,295,655 | A | 10/1981 | Landay et al. | 280/11.2 |
| 4,298,209 | A | 11/1981 | Peters | 280/11.2 |
| 4,303,253 | A | 12/1981 | Rottenkolber | 280/11.27 |
| 4,316,334 | A | 2/1982 | Hunt | 36/91 |
| 4,333,249 | A | 6/1982 | Schaefer | 36/115 |
| 4,364,187 | A | 12/1982 | Melendez | 36/15 |
| 4,412,685 | A | 11/1983 | Szamek | 280/11.19 |
| 4,417,737 | A | 11/1983 | Suroff | 280/11.115 |
| 4,442,614 | A | 4/1984 | Farberov | 36/103 |
| 4,492,046 | A | 1/1985 | Kosova | 36/27 |
| 4,496,025 | A | 1/1985 | Gattman | 182/121 |
| 4,523,767 | A | 6/1985 | Le Page | 280/11.19 |
| 4,638,575 | A | 1/1987 | Illustrato | 36/38 |
| 4,676,010 | A | 6/1987 | Cheskin | 36/32 R |
| 4,691,453 | A | 9/1987 | Tifre | 36/8.3 |
| 4,699,390 | A | 10/1987 | Cote | 280/11.23 |
| 4,763,909 | A | 8/1988 | Bergeron | 280/11.25 |
| 4,783,910 | A | 11/1988 | Boys, II et al. | 36/107 |
| 4,795,181 | A | 1/1989 | Armstrong | 280/87.04 A |
| 4,815,221 | A | 3/1989 | Diaz | 36/27 |
| 4,817,974 | A | 4/1989 | Bergeron | 280/11.2 |
| 4,841,648 | A | 6/1989 | Shaffer et al. | 36/43 |
| 4,843,737 | A | 7/1989 | Vorderer | 36/38 |
| 4,843,741 | A | 7/1989 | Yung-Mao | 36/114 |
| D302,994 | S | 8/1989 | Hawkes et al. | D21/227 |
| 4,887,824 | A | 12/1989 | Zatlin | 280/87.042 |
| 4,897,939 | A | 2/1990 | Harrington | 36/108 |
| 4,928,982 | A | 5/1990 | Logan | 280/11.22 |
| 4,947,560 | A | 8/1990 | Fuerst et al. | 36/88 |
| 4,977,691 | A | 12/1990 | Orchard, 3rd | 36/44 |
| 4,988,122 | A | 1/1991 | Saunders | 280/841 |
| 5,005,300 | A | 4/1991 | Diaz et al. | 36/114 |
| 5,056,240 | A | 10/1991 | Sherrill | 36/7.3 |
| 5,060,401 | A | 10/1991 | Whatley | 36/25 R |
| 5,134,791 | A | 8/1992 | Gregory | 36/107 |
| 5,195,257 | A | 3/1993 | Holcomb et al. | 36/28 |
| 5,224,278 | A | 7/1993 | Jeon | 36/29 |
| 5,232,231 | A | 8/1993 | Carlsmith | 280/11.215 |
| 5,236,058 | A * | 8/1993 | Yamet et al. | 180/181 |
| 5,236,224 | A | 8/1993 | Anderson et al. | 280/825 |
| 5,249,376 | A | 10/1993 | Capria | 36/115 |
| D341,179 | S | 11/1993 | Evans, III | D21/226 |
| 5,282,325 | A | 2/1994 | Beyl | 36/27 |
| 5,286,043 | A | 2/1994 | Tkaczyk | 280/11.22 |
| 5,319,866 | A | 6/1994 | Foley et al. | 36/91 |
| 5,319,869 | A | 6/1994 | McDonald et al. | 36/114 |
| D352,818 | S | 11/1994 | Bailey | D2/919 |
| 5,363,570 | A | 11/1994 | Allen et al. | 36/28 |
| 5,372,383 | A | 12/1994 | Kubierschky | 280/842 |
| 5,373,649 | A | 12/1994 | Choi | 36/42 |
| 5,381,608 | A | 1/1995 | Claveria | 36/35 R |
| 5,384,973 | A | 1/1995 | Lyden | 36/25 R |
| 5,388,350 | A | 2/1995 | Parker, Jr. | 36/115 |

5,392,537 A 2/1995 Goldberg ..... 36/134
5,393,077 A 2/1995 Wanous ..... 280/7.13
5,396,675 A 3/1995 Vincent et al. ..... 12/142 P
5,398,970 A 3/1995 Tucky ..... 280/841
5,410,821 A 5/1995 Hilgendorf ..... 36/100
5,417,444 A 5/1995 Chen ..... 280/87.042
5,419,060 A 5/1995 Choi ..... 36/36 R
5,425,186 A 6/1995 Hoyt ..... 36/97
5,469,642 A 11/1995 Farbman ..... 36/103
5,502,901 A 4/1996 Brown ..... 36/28
5,511,824 A 4/1996 Kim ..... 280/841
5,519,950 A 5/1996 Wang ..... 36/42
5,527,049 A 6/1996 Ortiz ..... 280/11.2
5,527,050 A 6/1996 Szendel ..... 280/11.22
5,544,431 A 8/1996 Dixon ..... 36/38
D373,674 S 9/1996 Dolinsky ..... D2/956
5,566,958 A 10/1996 Sinelnikov et al. ..... 280/11.231
5,572,804 A 11/1996 Skaja et al. ..... 36/29
5,586,777 A 12/1996 Wolf ..... 280/11.22
5,595,004 A 1/1997 Lyden et al. ..... 36/29
5,632,104 A 5/1997 Zohar ..... 36/88
5,633,544 A * 5/1997 Toida et al. ..... 310/67 R
5,638,614 A 6/1997 Hardy ..... 36/113
5,649,374 A 7/1997 Chou ..... 36/27
5,655,316 A 8/1997 Huang ..... 36/132
5,682,685 A 11/1997 Terlizzi ..... 36/8.3
5,692,322 A 12/1997 Lombardino ..... 36/100
5,697,643 A 12/1997 Marasco et al. ..... 280/825
5,716,074 A 2/1998 Theodorou ..... 280/843
5,716,723 A 2/1998 Van Cleef et al. ..... 428/690
5,730,467 A 3/1998 Huang ..... 280/843
5,743,028 A 4/1998 Lombardino ..... 36/27
5,769,432 A 6/1998 Tybinkowski et al. ..... 280/11.2
5,785,327 A 7/1998 Gallant ..... 280/11.27
5,787,609 A 8/1998 Wu ..... 36/28
5,797,466 A 8/1998 Gendle ..... 180/181
5,797,609 A 8/1998 Fichepain ..... 280/11.19
5,823,913 A 10/1998 Aruin et al. ..... 482/4
5,829,543 A 11/1998 Diaz ..... 180/181
5,836,591 A 11/1998 Roderick et al. ..... 280/11.22
5,839,737 A 11/1998 Kruczek ..... 280/11.115
D401,739 S 12/1998 James ..... D2/946
D402,797 S 12/1998 Kracke ..... D2/948
D404,550 S 1/1999 James ..... D2/960
5,881,413 A 3/1999 Throneburg et al. ..... 12/133 B
5,882,018 A 3/1999 Petrosino ..... 280/7.13
5,885,500 A 3/1999 Tawney et al. ..... 264/154
5,887,898 A 3/1999 Petrosino ..... 280/825
D408,123 S 4/1999 James ..... D2/969
5,927,729 A 7/1999 Di Filippo et al. ..... 280/11.3
5,927,734 A 7/1999 Horton, II et al. ..... 280/87.042
D412,778 S 8/1999 James ..... D2/951
D412,779 S 8/1999 James ..... D2/957
D413,193 S 8/1999 James ..... D2/947
5,930,918 A 8/1999 Healy et al. ..... 36/29
D414,021 S 9/1999 James ..... D2/951
D414,320 S 9/1999 Brent ..... D2/969
5,947,486 A 9/1999 Zell ..... 280/11.201
5,951,049 A 9/1999 Calverley et al. ..... 280/825
5,967,552 A 10/1999 Roderick et al. ..... 280/843
5,970,631 A 10/1999 Inman ..... 36/115
5,979,992 A 11/1999 Calderone et al. ..... 301/5.3
5,988,656 A 11/1999 Krah ..... 280/11.27
5,997,105 A 12/1999 Wu ..... 301/124.1
6,006,449 A 12/1999 Orlowski et al. ..... 36/27
6,006,450 A 12/1999 Hayes ..... 36/107
6,006,451 A 12/1999 Morris et al. ..... 36/115
D420,789 S 2/2000 James ..... D2/962
6,041,525 A 3/2000 Kelley ..... 36/115
6,042,125 A 3/2000 Wu ..... 280/11.27
6,050,357 A 4/2000 Staelin et al. ..... 180/65.1
6,055,747 A 5/2000 Lombardino ..... 36/37
6,061,930 A 5/2000 Zinovieff ..... 36/115
D426,374 S 6/2000 Kelley ..... D2/968
D426,948 S 6/2000 James ..... D2/968
6,070,887 A 6/2000 Cornelius et al. ..... 280/11.27
6,086,072 A 7/2000 Prus ..... 280/11.28
6,092,305 A 7/2000 Troy et al. ..... 36/3 B
6,115,943 A 9/2000 Gyr ..... 36/35 R
6,115,946 A 9/2000 Morris et al. ..... 36/115
6,120,039 A 9/2000 Clementi ..... 280/11.19
6,132,006 A 10/2000 Post ..... 301/5.3
D433,214 S 11/2000 McDowell ..... D2/957
6,151,806 A 11/2000 Morris et al. ..... 36/136
6,158,150 A 12/2000 Morris et al. ..... 36/115
6,170,837 B1 1/2001 Ross ..... 280/1
6,195,918 B1 3/2001 Kelley et al. ..... 36/115
6,195,920 B1 3/2001 Morris et al. ..... 36/132
D440,386 S 4/2001 James ..... D2/968
6,213,480 B1 4/2001 Rodriguez ..... 280/11.204
6,226,900 B1 5/2001 Mazars ..... 36/132
6,243,972 B1 6/2001 De France ..... 36/117.1
6,247,251 B1 6/2001 James ..... 36/115
6,247,708 B1 6/2001 Hsu ..... 280/11.223
6,250,656 B1 6/2001 Ibarra ..... 280/87.041
6,308,964 B1 10/2001 Chang ..... 280/11.19
6,336,644 B1 1/2002 Chu ..... 280/11.233
6,343,800 B2 2/2002 Clementi ..... 280/11.233
6,345,678 B1 2/2002 Chang ..... 180/181
6,354,609 B1 3/2002 Chen et al. ..... 280/11.3
6,357,145 B1 3/2002 James ..... 36/115
6,386,555 B1 5/2002 Kao ..... 280/7.13
6,406,037 B2 6/2002 Chang ..... 280/11.19
6,406,038 B2 6/2002 Adams ..... 280/11.24
6,406,039 B1 6/2002 Chen ..... 280/11.27
6,412,791 B1 7/2002 Chu ..... 280/11.19
6,450,509 B2 9/2002 Adams ..... 280/11.24
6,464,236 B2 10/2002 Chang ..... 280/11.223
6,467,198 B1 10/2002 James ..... 36/115
6,488,289 B2 12/2002 Hsiao et al. ..... 280/11.208
6,523,836 B1 2/2003 Chang et al. ..... 280/11.223
6,536,785 B2 3/2003 Lee ..... 280/11.27
6,572,120 B2 6/2003 Chang ..... 280/11.233
6,581,943 B2 6/2003 Wegener ..... 280/11.221
6,604,593 B1 8/2003 Mullet ..... 180/181
6,629,698 B2 10/2003 Chu ..... 280/11.19
6,698,769 B2 3/2004 Adams et al. ..... 280/11.233
6,719,304 B2 4/2004 Miller et al. ..... 280/11.27
6,739,602 B2 5/2004 Adams ..... 280/11.19
6,746,026 B2 6/2004 Adams ..... 280/11.19
6,751,891 B2 6/2004 Lombardino ..... 36/28
6,764,082 B2 7/2004 Roderick ..... 280/11.223
6,786,552 B2 9/2004 Thiel ..... 297/378.12
6,805,363 B2 10/2004 Hernandez ..... 280/11.19
6,848,201 B2 2/2005 Staffaroni et al. ..... 36/35 B
6,926,289 B2 8/2005 Wang ..... 280/7.13
6,979,003 B2 12/2005 Adams ..... 280/11.19
7,032,330 B2 4/2006 Adams ..... 36/115
7,059,437 B2 * 6/2006 Heinen ..... 180/65.5
7,063,336 B2 6/2006 Adams ..... 280/11.221
7,165,773 B2 1/2007 Adams ..... 280/11.19
7,165,774 B2 1/2007 Adams ..... 280/11.221
7,195,251 B2 3/2007 Walker ..... 280/11.19
2001/0022433 A1 9/2001 Chang
2002/0060435 A1 5/2002 Kim
2002/0070511 A1 6/2002 Adams
2002/0105153 A1 8/2002 Miller et al.
2002/0125655 A1 9/2002 Hsiao et al.
2002/0130475 A1 9/2002 Adams
2003/0047363 A1 * 3/2003 Makuta et al. ..... 180/65.5
2003/0062697 A1 4/2003 Chu
2003/0127811 A1 7/2003 Adams
2003/0132586 A1 7/2003 Wang
2003/0141680 A1 7/2003 Clark et al.
2003/0145493 A1 8/2003 Adams et al.
2003/0150133 A1 8/2003 Staffaroni et al.

| | | | | |
|---|---|---|---|---|
| 2003/0155725 | A1 | 8/2003 | Roderick | |
| 2004/0007835 | A1* | 1/2004 | Yang | 280/11.19 |
| 2004/0066011 | A1 | 4/2004 | Chu et al. | 280/11.19 |
| 2004/0212160 | A1 | 10/2004 | Roderick | |
| 2004/0239056 | A1 | 12/2004 | Cho | |
| 2006/0022417 | A1 | 2/2006 | Roderick | |
| 2006/0038362 | A1 | 2/2006 | Svensson et al. | 280/11.221 |
| 2007/0090613 | A1 | 4/2007 | Lyden | 280/11.221 |
| 2007/0164519 | A1 | 7/2007 | Adams | 280/7.13 |
| 2007/0252351 | A1 | 11/2007 | McNamara | 280/11.24 |
| 2008/0313928 | A1 | 12/2008 | Adams et al. | 36/103 |

FOREIGN PATENT DOCUMENTS

| | | | | |
|---|---|---|---|---|
| BR | 19506566-0 | A | 1/1995 | |
| CA | 1-138-194 | | 12/1982 | 36/6 |
| CA | 1-239-017 | | 7/1988 | 36/6 |
| CA | 2258978 | | 7/2000 | |
| CA | 2258980 | | 7/2000 | |
| CH | 84073 | | 2/1920 | |
| CN | 85 2 04533 | U | 10/1986 | |
| CN | DES. ZL 98300231.2 | | 1/1998 | |
| CN | ZL 97244602.8 | | 4/1999 | |
| CN | 2520912 | Y | 11/2002 | |
| CN | 03316715X | | 11/2003 | |
| DE | 254775 | | 5/1912 | |
| DE | 309567 | A | 10/1918 | 280/11.227 |
| DE | 456796 | | 3/1928 | 280/843 |
| DE | 723266 | | 8/1942 | 77/19 B |
| DE | 821323 | | 7/1949 | |
| DE | 204456 | | 12/1958 | |
| DE | 2321669 | | 3/1974 | |
| DE | 2550211 | A1 | 5/1976 | |
| DE | 2615266 | A1 | 10/1977 | |
| DE | 2821644 | A1 | 5/1978 | |
| DE | 19500589 | A1 | 7/1996 | |
| DE | 29613508 | U1 | 10/1996 | |
| DE | 197 55 340 | | 6/1999 | |
| DE | 19837270 | A1 | 2/2000 | |
| DE | 20012020 | U1 | 11/2000 | |
| DE | 20023053.0 | | 10/2002 | |
| EP | 0933104 | | 8/1999 | |
| EP | 1254686 | A1 | 11/2002 | |
| EP | 1530915 | A1 | 5/2005 | |
| ES | 222715 | Y | 8/1976 | |
| ES | 248126 | Y | 12/1980 | |
| ES | 1047932 | U | 6/2001 | |
| ES | 1048059 | U | 6/2001 | |
| ES | 1048274 | U | 7/2001 | |
| ES | 1048293 | U | 7/2001 | |
| ES | 1048400 | U | 8/2001 | |
| FR | 1194886 | A | 11/1959 | |
| FR | 2196826 | | 3/1974 | |
| FR | 2291715 | | 6/1976 | |
| FR | 2757412 | A1 | 6/1998 | |
| FR | 2822077 | A1 | 9/2002 | |
| GB | 2297 | | 6/1877 | |
| GB | 117176 | | 7/1918 | |
| GB | 150512 | A | 9/1920 | |
| GB | 216903 | A | 1/1925 | |
| GB | 2363562 | | 3/2000 | |
| GB | 2407993 | | 3/2006 | |
| IT | 666436 | | 8/1964 | |
| JP | 6417 | | 8/1907 | |
| JP | 17-3781 | | 3/1942 | |
| JP | 368449 | | 12/1949 | |
| JP | 50-139077 | | 11/1975 | |
| JP | 56-1685 | | 1/1981 | |
| JP | 57-145459 | | 9/1982 | |
| JP | 58-30474 | | 2/1983 | |
| JP | 58-142078 | | 9/1983 | |
| JP | 59-55574 | | 4/1984 | |
| JP | 61-94621 | | 6/1986 | |
| JP | 63-135673 | | 9/1988 | |
| JP | 2-82903 | | 6/1990 | |
| JP | 5-40721 | | 10/1993 | |
| JP | 7-79804 | | 3/1995 | |
| JP | 9-508826 | | 9/1997 | |
| JP | 10-509059 | | 9/1998 | |
| KR | 90-11303 | | 3/1988 | |
| KR | 20020065437 | | 8/2002 | |
| KR | 20030051516 | A | 6/2003 | |
| KR | 20-0325185 | | 8/2003 | |
| KR | 10-0452961 | B1 | 10/2004 | |
| KR | 20-0364789 | | 10/2004 | |
| KR | 20-0369807 | | 11/2004 | |
| KR | 20-0378100 | | 2/2005 | |
| KR | 20-0398724 | | 10/2005 | |
| KR | 10-0572144 | | 4/2006 | |
| KR | 10-0572145 | | 4/2006 | |
| SE | 386828 | B | 8/1972 | |
| WO | WO 92/05845 | | 4/1992 | |
| WO | WO 95/20424 | | 8/1995 | |
| WO | WO 96/40393 | | 12/1996 | |
| WO | WO 98/01051 | | 1/1998 | |
| WO | 9826845 | | 6/1998 | |
| WO | 0042696 | | 7/2000 | |
| WO | 0059323 | | 10/2000 | |
| WO | WO 02/11831 | A1 | 2/2002 | |
| WO | 03059475 | | 7/2003 | |
| WO | 2009025798 | | 2/2009 | |

OTHER PUBLICATIONS

Advertisement for "Street Flyers" at the Internet website for FAO Schwartz, www.fao.com/faoschwarz/streetflyers.html dated_Dec. 17, 1999, 3 pages.

Advertisement for "Street Flyers" at the Internet website for StreetFlyers, www.streetflyers.com/cgi-bin-ncommerce3/ExecMacro/home.d2w/report_dated_Jan. 24, 2000, 7 pages.

Advertisement on eBay "Wheelyz-Like Heelys Blue Skate Shoe" located at internet website: http://cgi.ebay.com/Wheelyz-Like-Heelys-Blue-Skate-Shoe_W0QQitemZ7173785832QQcategoryZ22704 . . . , dated Aug. 4, 2005; 6 pages.

Advertisement for Motoboard located at internet website: http://www.motoboard.com/moto4/images/Cntr/cover.jpg, dated Aug. 1, 2005, 1 pg.

Advertisement for "Wheelman's—Bushpig" located at internet website: http://extremetoysforboys.com/index.php3/item/item/Wheelman's%20-%20Bushpig.html, dated Aug. 1, 2005, 4 pages.

Advertisement for "Motosk8®- Motorized Inline Skate" located at internet website: http://extremetoysforboys.com/index.php3/item/item/MotoSk8®%20=%20Motorized%20Inl . . . , dated Aug. 1, 2005, 4 pages.

Advertisement photos for "Motosk8®- Motorized Inline Skate" located at internet website: http://extremetoysforboys.com/images/items/MotoSk8-Lg.jpg, dated Aug. 1, 2005, 1 page.

Advertisement photos for "Motosk8®- Motorized Inline Skate" located at internet website: http://extremetoysforboys.com/images/items/MotoSk8-Lg2.jpg, dated Aug. 2, 2005, 1 page.

Advertisement for "Motoboard®" located at internet website: http://www.motoboard.com/moto4/html/products/motoboard.html, dated Aug. 2, 2005, 2 pages.

Advertisement for "All-Terrain Surfer" located at internet website: http://motoboard.com/moto4/html/products/rhino.html, dated Aug. 2, 2005, 3 pages.

Advertisement for iShoes located at internet website: http://theishoes.com dated Dec. 5, 2007 (4 pgs).

Wilhite "The Evolution of the Roller Skate: 1820 - Present" Nat'l Museum of Roller Skating; 1994; pp. 1-149.

Turner et al. "National Museum of Roller Skating - The History of Roller Skating" 1997; pp. 1-112.

Brooslin "The First Fifty Years: American Roller Skates 1860-1910" Nat'l Museum of Roller Skates; 1983; (41 pgs - entire catalogue).

Zaidman "Awards & Honors of the Roller Skating Association International"; Nat'l Museum of Roller Skating; 1998; pp. 1-78.
Nelson, Cotton "He Found Momentum in Discarded Skates" Memphis Press Scimitar Mar. 20, 1980 (News article re multi-wheel shoe roller skate with wheels in soles and heels).
*Heeling Sports Limited* v. *China Direct Importers, LLC* et al. filed Dec. 5, 2007; Civil Action No. 6:07-cv-01922-ACC-DAB; USDC, Middle District of Florida (Orlando). Attached is a copy of the following documents: Docket Report dated Dec. 16, 2008 (10 pgs) Complaint (filed Dec. 5, 2007) Answer - Ebraheem Husni Alsamadi (filed Dec. 27, 2007) Answer - Husni Dawud Alsamadi (filed Dec. 27, 2007) Answer - Charaf Benaffane (filed Jan. 2, 2008) Answer - Siwei International Co and Yan Zhou (filed Jan. 7, 2008) Answer - F&R Imports, Inc. and Fadi Alsmadi (filed Feb. 22, 2008) Notice of Voluntary Dismissal (filed May 28, 2008).
*Heeling Sports Limited* v. *Aldi Inc.* filed Dec. 10, 2007; Civil Action No. 3:07-cv-02057; USDC, Northerr District of Texas (Dallas). Attached is a copy of the following documents: Docket Report dated Dec. 16, 2008 (10 pgs) Complaint (filed Dec. 10, 2007) Answer and Counterclaim (filed Feb. 6, 2008) Answer to Defendant's Counterclaim (filed Feb. 26, 2008) First Amended Complaint (filed Jul. 30, 2008) Joint Motion for Dismissal - Heeling/Aldi only (filed Nov. 10, 2008).
*Heeling Sports Limited* v. *Paskey et al.* filed Dec. 20, 2007; Civil Action No. 3:07-cv-02123; USDC, Northern District of Texas (Dallas). Attached is a copy of the following documents: Docket Report dated Dec. 17, 2008 (8 pgs) Amended Complaint (filed Mar. 6, 2008) Answer - Kendra Paskey (filed Mar. 25, 2008) Answer - Be Beautiful Llc (filed Mar. 25, 2008) Permanent Injunction and Final Judgment (filed Nov. 12, 2008) Answer - New Concord (filed Feb. 20, 2009).
*Heeling Sports Limited* v. *Reddy* filed Dec. 20, 2007; Civil Action No. 3:07-cv-02126; USDC, Northern District of Texas (Dallas). Attached is a copy of the following documents: Docket Report dated Dec. 17, 2008 (3 pgs) Complaint (filed Dec. 20, 2007) Final Judgment (filed Jun. 9, 2008).
*Heeling Sports Limited* v. *Ohayon* filed Nov. 22, 2006; Civil Action No. 3:06-cv-02167; USDC, Northern District of Texas (Dallas). Attached is a copy of the following documents: Docket Report dated Dec. 17, 2008 (5 pgs) Complaint (filed Nov. 22, 2006) Answer (filed Dec. 14, 2006) Final Judgment (filed Oct. 19, 2007).
*Heeling Sports Limited* v. *My Roller Shoes* et al. filed Nov. 29, 2007; Civil Action No. 2:07-cv-07783-DSF-SH; USDC, Central District of California (Western Division-Los Angeles). Attached is a copy of the following documents: Docket Report dated Dec. 17, 2008 (11 pgs) Amended Complaint (filed Jan. 14, 2008) Notice of Errata (to include Exhibit D to Amended Complaint) (filed Jan. 15, 2008) Second Amended Complaint (filed Jul. 10, 2008) Answer to Second Amended Complaint - Jin-Fu Lei (filed Sep. 11, 2008) Permanent Injunction and Judgment (filed Nov. 21, 2008).
*Heeling Sports Limited* v. *E & R Generations, LLC* et al. filed Jan. 30, 2007; Civil Action No. 1:07-cv20245-Jem; USDC, Southern District of Florida (Miami). Attached is a copy of the following documents: Docket Report dated Dec. 17, 2008 (14 pgs) Complaint (filed Jan. 30, 2007) Answer - E&R Generations, LLC et al. (filed Feb. 26, 2007) Answer - M.E.M. Cotton Corporation (filed Mar. 28, 2007) Agreed Final Order of Dismissal (entered Aug. 28, 2008).
*Heeling Sports Limited* v. *Linson USA Inc.* et al. filed Feb. 8, 2008; Civil Action No. 3:08-cv-00231; USDC, Northern District of Texas (Dallas). Attached is a copy of the following documents: Docket Report dated Dec. 16, 2008 (5 pgs) Complaint (filed Feb. 8, 2008) Order (entered Aug. 28, 2008) Response - Linson et al. (filed Sep. 9, 2008).
*Heeling Sports Limited* et al. v. *Airrollershoes.com* et al. filed Mar. 19, 2007; Civil Action No. 5:07-cv00318-VAP-OP; USDC, Central District of California (Eastern Division-Riverside). Attached is a copy of the following documents: Docket Report dated Dec. 16, 2008 (12 pags.) Amended Complaint (filed Mar. 20, 2007) Amended Answer (filed Oct. 2, 2007) Amended Judgment Pursuant to Default (filed Aug. 29, 2008).
*Heeling Sports Limited* v. *Air Rider International Corp* et al. filed Jan. 18, 2007; Civil Action No. 2:07-cv00450-PSG-CT; USDC, Central District of California (Western Division - Los Angeles). Attached is a copy of the following documents: Docket Report dated May 5, 2008 (7 pgs) Complaint (filed Jan. 18, 2007) Answer (filed Mar. 30, 2007).
*Heeling Sports Limited* v. *Levy Marketing, Inc.* et al. filed Dec. 7, 2006; Civil Action No. 1:06-cv-22965-FAM; USDC, Southern District of Florida (Miami). Attached is a copy of the following documents: Docket Report dated May 5, 2008 (3 pgs) Complaint (filed Dec. 7, 2006) Answer (filed Dec. 28, 2006) Answer (filed Jan. 2, 2007).
*Heeling Sports Limited* v. *USA AiSiQi Shoes Inc.* et al. filed Apr. 2, 2007; Civil Action No. 2:07-cv02156-DDP-JC; USDC, Central District of California (Western Division-Los Angeles). Attached is a copy of the following documents: Docket Report dated Dec. 17, 2008 (9 pgs) Complaint (filed Apr. 2, 2007) Answer (filed Apr. 17, 2007) Consent Decree and Permanent Injunction (filed Jun. 18, 2008).
*Heeling Sports Limited* v. *Bob Shoes International Inc* et al. filed Apr. 9, 2007; Civil Action No. 2:07-cv02343-GAF-AJW; USDC, Central District of California (Western Division- Los Angeles). Attached is a copy of the following documents: Docket Report dated Dec. 17, 2008 (9 pgs) Complaint (filed Apr. 9, 2007) Answer (filed Jul. 12, 2007) Permanent Injunction and Judgment (filed May 14, 2008).
*Heeling Sports Limited* v. *Jie Sun* et al. filed Sep. 21, 2007; Civil Action No. 2:07-cv-06151-GPS-JTL;USDC, Central District of California (Western Division-Los Angeles). Attached is a copy of the following documents: Docket Report dated Dec. 17, 2008 (5 pgs) Complaint (filed Sep. 21, 2007) Judgment and Permanent Injunction (dated Nov. 8, 2007).
*Heeling Sports Limited* v. *Master Products* et al. filed Apr. 9, 2007; Civil Action No. 2:07-cv-02346-FMCSH; USDC, Central District of California (Western Division - Los Angeles). Attached is a copy of the following documents: Docket Report dated Dec. 17, 2008 (11 pgs) Complaint (filed Apr. 9, 2007) Answer (filed May 22, 2007) Permanent Injunction and Judgment (filed Aug. 25, 2008).
*Heeling Sports Limited* v. *F&R Imports, Inc.* et al. filed Dec. 5, 2007; Civil Action No. 6:08-cv-00564-ACC-DAB; USDC, Middle District of Florida (Orlando). Attached is a copy of the following documents: Docket Report dated Dec. 16, 2008 (10 pgs) Amended Complaint (filed Apr. 18, 2008) Answer to Amended Complaint - F&R Imports, Inc., Fadi Alsmadi (filed May 2, 2008) Permanent Injunction and Final Judgment (entered Nov. 3, 2008).
*Heeling Sports Limited* v. *Wal-Mart Stores Inc.* et al. filed Oct. 5, 2007; Civil Action No. 3:07-cv-01695; USDC, Northern District of Texas (Dallas). Attached is a copy of the following documents: Docket Report dated May 19, 2008 (3 pgs) Amended Complaint (filed Oct. 18, 2007) Agreed Final Judgment (filed Mar. 13, 2008).
*Heeling Sports Limited* et al. v. *Skechers Usa Inc.* filed Apr. 4, 2002; Civil Action No. 4:02-cv-00101-LED; USDC, Eastern District of Texas (Sherman). Attached is a copy of the following documents: Docket Report dated Dec. 16, 2008 (7 pgs) Complaint (filed Apr. 4, 2002) Answer (filed Jun. 7, 2002).
*Skechers USA Inc.* v. *Heeling Sports,* et al. filed Mar. 6, 2002; Civil Action No. 2:02-cv-01906-HLH-RC; USDC, Western Division of California (Los Angeles). Attached is a copy of the following documents; Docket Report dated Dec. 16, 2008 (10 pages) Complaint (filed Mar. 6, 2002).
*Heeling Sports Limited* et al. v. *Skechers USA Inc.* filed Jun. 18, 2002; Civil Action No. 4:02-cv-00169-LED; USDC, Eastern District of Texas (Sherman). Attached is a copy of the following documents: Docket Report dated Dec. 16, 2008 (7 pgs) Amended Complaint (filed Jun. 21, 2002) Report re: Final Judgment on Consent is Sealed (filed Dec. 19, 2002).
*Skechers Usa Inc.* v. *Heeling Sports,* et al. filed Jun. 18, 2002; Civil Action No. 2:02-cv-04779-HLH-RC; USDC, Western Division of California (Los Angeles). Attached is a copy of the following documents: Docket Report dated Dec. 16, 2008 (6 pgs) Complaint (filed Jun. 18, 2002).
*Heeling Sports Limited* v. *Linson International Inc.* filed Nov. 14, 2003; Civil Action No. 3:03-cv-02772; USDC, Northern District of Texas (Dallas). Attached is a copy of the following documents: Docket Report dated May 5, 2008 (2 pgs) Complaint (filed Nov. 14, 2003) Default Judgment (entered Dec. 9, 2004).
*Heeling Sports Limited* v. *U.S. Furong Intl Inc.* et al. filed Nov. 30, 2006; Civil Action No. 2:06-cv07624-FMC-PLA; USDC, Central District of California (Western Division-Los Angeles). Attached is a copy of the following documents: Docket Report dated Dec. 17, 2008 (19 pgs) Complaint (tied Nov. 30, 2006) Judgment Pursuant to Default (filed Jun. 3, 2008).

*Heeling Sports Limited* v. *Wheely's World, Inc.* et al. filed Dec. 5, 2007; Civil Action No. 6:08-cv-00565-ACC-DAB; USDC, Middle District of Florida (Orlando). Attached is a copy of the following documents: Docket Report dated Dec. 16, 2008 (10 pgs) Amended Complaint (filed Apr. 18, 2008) Answer to Amended Complaint (filed Jul. 14, 2008) Order of Dismissal (entered Nov. 10, 2008).

*Heeling Sports Limited* v. *Siwei International Company* et al. filed Dec. 5, 2007; Civil Action No. 6:08-cv00566-ACC-DAB; USDC, Middle District of Florida (Orlando). Attached is a copy of the following documents: Docket Report dated Dec. 16, 2008 (10 pgs) Amended Complaint (filed Apr. 18, 2008) Answer to Amended Complaint (filed May 2, 2008).

*Heeling Sports Limited* v. *General Growth Properties Inc* et al. filed Nov. 20, 2008; Civil Action No. 3:08-cv-02070-G-BD; USDC, Northern District of Texas (Dallas). Attached is a copy of the following documents: Docket Report dated Dec. 16, 2008 (3 pgs) Complaint (filed Nov. 20, 2008).

*Heeling Sports Limited* v. *Dolgencorp, LLC* et al filed Nov. 24, 2008; Civil Action No. 3:08-cv-02095-L; USDC, Northern District of Texas (Dallas). Attached is a copy of the following documents: Docket Report dated Dec. 16, 2008 (2 pgs) Complaint (filed Nov. 24, 2008).

*Heeling Sports Limited* v. *Ebraheem Husni Alsamadi* et al filed Dec. 5, 2007; Civil Action No. 6:08-cv00567-ACC-DAB; USDC, Middle District of Florida (Orlando). Attached is a copy of the following documents: Docket Report dated Dec. 16, 2008 (11 pgs) Amended Complaint (filed Apr. 18, 2008) Reply to Amended Complaint (filed Jun. 26, 2008) Order of Dismissal (entered Nov. 10, 2008).

*Heeling Sports Limited* v. *Advan Fashion, Inc.* et al filed Dec. 4, 2006; Civil Action No. 6:06-cv-01834-JA-DAB; USDC, Middle District of Florida (Orlando). Attached is a copy of the following documents: Docket Report dated Dec. 16, 2008 (8 pgs) Complaint (filed Dec. 4, 2006) Answer (filed Jan. 19, 2007) Order granting Motion for Default Judgment (entered Feb. 21, 2008) Final Default Judgment and Injunction (entered Feb. 21, 2008).

*Heeling Sports Limited* v. *Filo Corporaton* et al filed Aug. 11, 2008; Civil Action No. 1:08-cv-22248-CMA; USDC, Southern District of Florida (Miami). Attached is a copy of the following documents: Docket Report dated Dec. 17, 2008 (3 pgs) Complaint (filed Aug. 11, 2008).

*Heeling Sports Limited* v. *Nextex Enterprises Inc* filed Feb. 5, 2009; Civil Action No. 3:09-cv-00240-G; USDC, Northern District of Texas (Dallas). Attached is a copy of the following documents: Docket Report dated Mar. 30, 2009 (3 pgs) Complaint (filed Feb. 5, 2009) Defendant's Original Answer (filed Mar. 24, 2009).

* cited by examiner

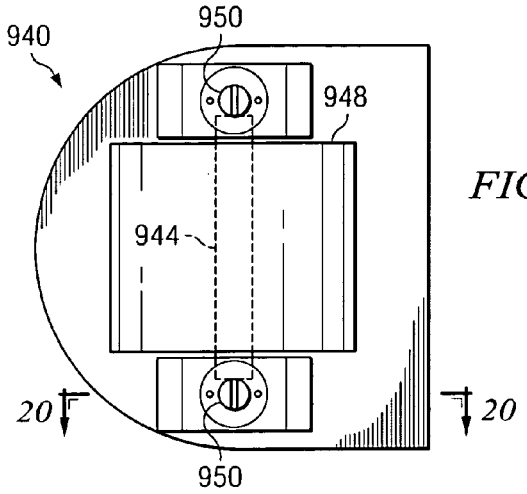
FIG. 19
FIG. 20
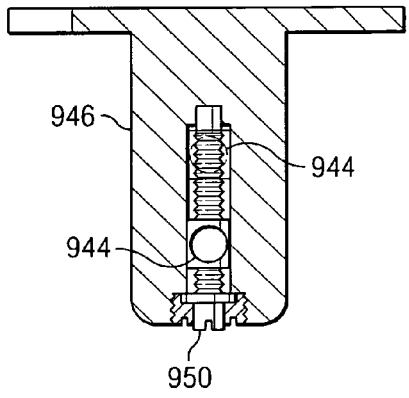
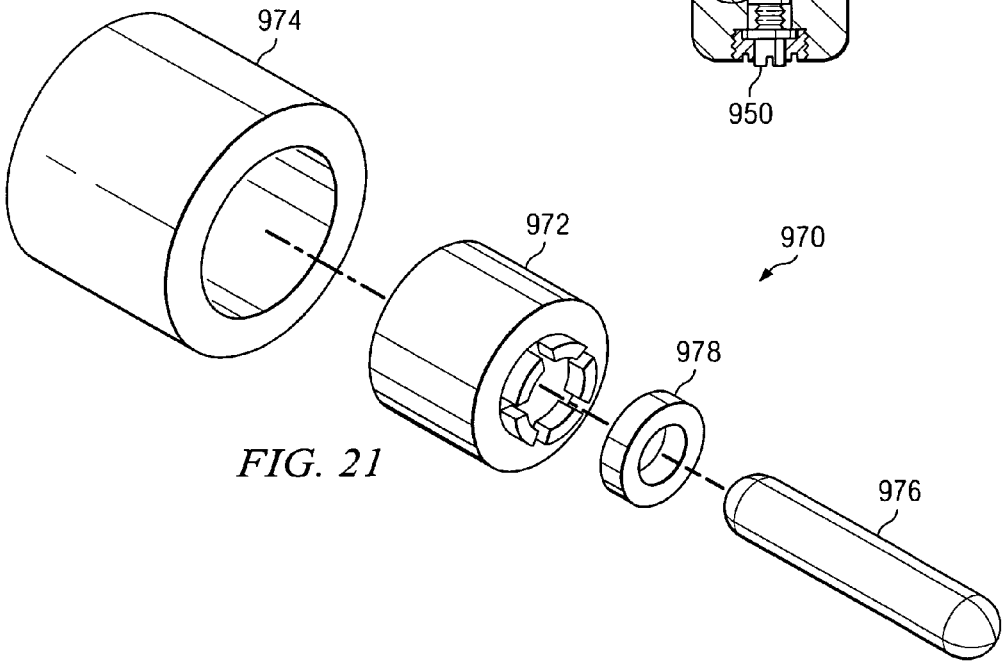
FIG. 21

MOTORIZED TRANSPORTATION APPARATUS AND METHOD

CROSS-REFERENCE TO RELATED APPLICATIONS

Pursuant to 35 U.S.C. § 119 (e), this application claims priority from, and hereby incorporates by reference for all purposes, U.S. Provisional Patent Application Ser. No. 60/599,043, entitled *Motorized Heelys*, naming Roger R. Adams and Patrick F. Hamner as inventors, and filed Aug. 4, 2004.

This application is related to the following U.S. patent applications and patents: U.S. Provisional Patent Application Ser. No. 60/127,459, entitled *Heeling Apparatus and Method*, naming Roger R. Adams inventor, and filed Apr. 1, 1999; U.S. Pat. No. 6,450,509, entitled *Heeling Apparatus and Method*, naming Roger R. Adams inventor, and filed Mar. 31, 2000; U.S. Pat. No. 6,450,509, entitled *Heeling Apparatus and Method*, naming Roger R. Adams inventor, and filed Mar. 31, 2000; U.S. Pat. No. 6,406,038, entitled *Heeling Apparatus and Method*, naming Roger R. Adams inventor, and filed Aug. 14, 2001; U.S. Pat. No. 6,739,602, entitled Heeling Apparatus and Method, naming Roger R. Adams inventor, and filed Feb. 7, 2002; U.S. Pat. No. 6,746,026, entitled *Heeling Apparatus and Method*, naming Roger R. Adams inventor, and filed Feb. 15, 2002; U.S. patent application Ser. No. 10/863,090, entitled *Heeling Apparatus and Method*, naming Roger R. Adams inventor, and filed Jun. 7, 2004; U.S. Pat. No. 6,698,769, entitled *Multi-Wheel Heeling Apparatus*, naming Roger R. Adams and Michael G. Staffaroni inventors, and filed Feb. 3, 2003; and U.S. patent application Ser. No. 10/369,063, entitled *External Wheeled Heeling Apparatus and Method*, naming Roger R. Adams inventor, and filed Feb. 18, 2003. Various other patents and patent applications related to the aforementioned patents and patent applications have issued or are pending in various countries around the world. All of the patents and patent applications mentioned in this paragraph are hereby incorporated by reference for all purposes.

TECHNICAL FIELD OF THE INVENTION

The present invention relates generally to the field of motorized transportation and more particularly, but not by the way of limitation, to a motorized transportation apparatus and method, including a motorized heeling apparatus, a motorized footwear, a motorized heat bracket and a motorized wheel assembly.

BACKGROUND OF THE INVENTION

Since their introduction, footwear with one or more wheels located in, under or adjacent the heel have become extremely popular throughout the world. Marketed under the brand HEELYS, the capability to walk or run and then to transition to passive rolling on the one or more wheels has mass appeal in cities, locations and cultures throughout the world.

Most motorized devices for transporting people require large frames or structures to support a large (or somewhat large) motor and associated gearing, transmission and power source. Unfortunately, this often makes such devices cumbersome and, in many instances, cost prohibitive. Substantial difficulty often arises when storing, parking and maintaining motorized transportation devices. It is often difficult, prohibited or not recommended to leave motorized transportation devices unattended.

Further, the presence of motors, especially large motors, and associated hardware often decrease, alter or limit the performance of transportation devices. For example, a gas motor on the back of a skateboard will substantially change the center of mass of the skateboard and result in a substantially different performing skateboard.

SUMMARY OF THE INVENTION

From the foregoing it may be appreciated that a need has arisen for a motorized transportation apparatus and method, including a motorized heeling apparatus, a motorized heel bracket, a motorized wheel assembly and a motorized footwear, including associated methods that may include using motorized footwear or apparatus to allow walking or running on a forefoot of a sole, and then transition to passive rolling, i.e., without power assistance from an electric motor, and then transition to electric powered rolling using a conveniently positioned and configured electric motor and power source. In accordance with the present invention, a motorized transportation apparatus and method are provided that substantially eliminate one or more of the disadvantages and problems outlined above.

According to an aspect of the present invention, a motorized heeling apparatus for walking and rolling on a surface in a forward direction. The motorized heeling apparatus may include a wheel, an axle, an electric motor, and footwear. The wheel rolls on the surface in the forward direction, the axle is positioned within an opening in the wheel, the electric motor rotates the axle in the forward rotational direction when the electric motor is engaged to provide forward rotational motion to the axle, the footwear has a sole with a heel portion, and wherein the wheel is positioned adjacent the heel portion of the sole such that, in use, in a non-rolling mode a primary contact of the motorized heeling apparatus with the surface is provided by the forefoot portion of the sole and, in a passive rolling mode, the wheel provides the primary contact with the surface to allow a user to roll in a forward direction on the surface while the wheel rotates in the forward rotational direction, a change in mode being effected by a transfer of weight of the user from the forefoot portion of the sole to the wheel, and, in an electric powered rolling mode, the wheel provides the primary contact with the surface to allow the user to roll in a forward direction on the surface with the electric motor engaged to rotate the axle and the wheel in the forward rotational direction.

According to another aspect, the present invention may include a method for using a motorized heeling apparatus in a non-rolling mode, a passive rolling mode, and an electric powered rolling mode to move in a forward direction on a surface. The method may further include walking on the surface in the forward direction, in a non-rolling mode, using the bottom surface of the forefoot portion of the footwear of the motorized heeling apparatus; transitioning to a passive rolling mode by transferring a user's weight from the forefoot portion to a wheel provided adjacent the heel portion of the footwear of the motorized heeling apparatus, wherein the wheel provides the primary contact with the surface to allow the user to roll in the forward direction on the surface while the wheel rotates in a forward rotational direction; and transitioning to an electric powered rolling mode by providing electrical power to the electric motor of the motorized heeling apparatus to provide rotational power to the wheel in the forward rotational direction, wherein the wheel continues to provide the primary contact with the surface to allow the user to roll in the forward direction on the surface while the wheel rotates in a forward rotational direction.

According to another aspect, the present invention may include a motorized heeling apparatus for walking and rolling on a surface in a forward direction, and the motorized heeling apparatus may include a wheel, an electric motor, a coupling, a battery, a throttle, and a footwear. The wheel may be positioned adjacent a heel portion of a sole of the footwear such that, in use, in a non-rolling mode a primary contact of the motorized heeling apparatus with the surface is provided by the forefoot portion of the sole and, in an electric powered rolling mode, the wheel provides the primary contact with the surface to allow a user to roll in a forward direction on the surface while the electric motor is engaged to rotate the wheel in the forward rotational direction, a change in mode being effected by a transfer of weight of the user from the forefoot portion of the sole to the wheel. The battery provides electrical power to the electric motor, the throttle is used to control the amount of electrical power provided to the electric motor, and the coupling may include any known or available coupling, gear, transmission or other mechanical arrangement to transfer the rotating mechanical energy of the shaft of the electric motor to rotate the wheel.

According to yet another aspect, the present invention may include a motorized heel bracket formed to receive a footwear of a user for walking and rolling on a surface in a forward direction, the motorized heel bracket may include a wheel, an electric motor, a coupling, a throttle, and a heel bracket. The footwear may have a sole with a forefoot portion, an arch portion and a heel portion with a bottom surface. The wheel may be positioned adjacent the heel bracket such that, in use with the footwear, in a non-rolling mode a primary contact with the surface is provided by the forefoot portion of the sole of the footwear and, in an electric powered rolling mode, the wheel provides the primary contact with the surface to allow the user to roll in the forward direction on the surface while the electric motor is engaged to rotate the wheel in the forward rotational direction, a change in mode being effected by a transfer of weight of the user from the forefoot portion of the sole of the footwear to the wheel.

According to still yet another aspect, the present invention may include a motorized wheel assembly that includes an electric motor with a rotatable housing that surrounds all or most of the motor windings or coils of the electric motor, and a wheel positioned around the rotatable housing. The wheel and the rotatable housing are operable to serve as a roller to roll on a surface when electrical power is applied to the electric motor, such as by a battery. The motorized wheel assembly may be used in a motorized footwear, with one in the back and a passive roller in the front of the footwear, or with multiple motorized wheel assemblies adjacent or under the footwear to provide power to propel the footwear forward. A battery may be positioned virtually any location that is convenient, such as the upper part of the footwear, on a belt, within the arch of the footwear, etc. A throttle, and related motor control circuitry, if needed, may be used. In a preferred embodiment, the throttle is a wireless throttle.

The motorized wheel assembly, in another aspect, may be used in a motorized personal transportation apparatus for transporting a person from a first location to a second location on a surface. The motorized personal transportation apparatus may include a support structure, such as a platform or other structure, operable to support a person above the surface when transporting the person from the first location to the second location when powered by the motorized wheel assembly. The motorized personal transportation apparatus may be implemented in a motorized inline skate, motorized quad skate, motorized skateboard, motorized heeling apparatus, motorized scooter, motorized wheelchair, motorized platform, motorized personal mobility device, motorized grocery basket, and any of a variety of other apparatus and systems.

The various embodiments and implementations of the present invention provide a profusion of potential technical advantages and benefits that will generally include one or more of the following. A technical advantage of the present invention may include the capability to conveniently and more easily travel from a first location to a second location that include both walking and electric power assisted rolling (which may be referred to herein as "active rolling" or "electric powered rolling"), without the need for a large framed or cumbersome electric powered device such as a SEGWAY platform, electric scooter or moped.

Another technical advantage of the present invention may include the capability to conveniently travel to a destination using electric power, without the need for a separate parking or storage location at the destination to store or secure a separate or large motorized transportation device.

Still yet another technical advantage of the present invention may include the capability to eliminate or reduce the need for a heavy structure that may be inconvenient to operate or impede overall performance.

Yet another technical advantage of the present invention may include the capability to decrease costs involved in the initial purchase price and operational costs of a personalized transportation device.

Still yet another technical advantage of the present invention may include the capability to more effectively and conveniently provide electric motor power to wheeled devices, such as skateboards, in-line skates, quad skates, scooters, wheelchairs, grocery store baskets and the like. Heavy motors and associated hardware applied to a non-motorized device change the mechanical and physical characteristics of the apparatus. In certain embodiments of the present invention, the capability to use an electric motor within a wheel (or functioning as the wheel) of an apparatus to power the apparatus, or to locate a small motor at a strategic location on the apparatus, may provide the technical advantage of minimizing any change to the operational and mechanical performance of the apparatus.

Other technical advantages and benefits may be readily apparent to one skilled in the art from the following detailed description of the invention when read in conjunction with the accompanying figures and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 19 is a bottom view that illustrates the wheel assembly of FIG. 18 that further illustrates the dual king pin arrangement;

FIG. 20 is a side view that illustrates one member of the mounting structure that further illustrates the coupling of the axle to the mounting structure using the dual king pin arrangement;

FIG. 21 is a breakaway and perspective view that illustrates a two piece wheel that includes an inner core and an outer tire and that may be used in the present invention;

DETAILED DESCRIPTION OF THE INVENTION

It should be understood at the outset that although an exemplary implementation of the present invention is illustrated below, the present invention may be implemented using any number of mechanisms, arrangements, structures, and/or techniques, whether currently known or in existence. The present invention should in no way be limited to the exemplary implementations, drawings, and techniques illustrated below, including the exemplary design and implementations illustrated and described herein. Additionally, the drawings contained herein are not necessarily drawn to scale.

FIGS. 1 through 21 are illustrated herein to illustrate various aspects of a motorized heeling apparatus and method, without specifically referencing or illustrating a motor, which is described and illustrated more fully in further drawings. The term "motor" or "motorized" as used throughout this application should be understood to include all electric motors, including dc, ac, brush, brushless, sensor or sensorless electric motors. It should be understood that the motor may be integrated into a wheel, or external the wheel, such as through a gear or mechanical linkage arrangement. Further, motor controls, such as electronic speed controllers (or voltage controllers/regulators or motor controllers) may be included and used in connection with a throttle (such as a rheostat, for example) to control the amount of power or energy delivered by the energy or power source, such as a battery or series of batteries. The throttle, which may be spring-loaded and may include a "dead man" switch, may be hardwired to control the speed or rpm's of the motor, or it may be a wireless or radio frequency "rf" throttle.

The controller may be internal or external the motor housing or casing. Further, it should be understood that the motor may be on only one shoe or footwear, or on both footwear. The motor may be permanently affixed or it may be removable. The wheel or wheels may be removable, permanently affixed and/or retractable.

Figure 1:
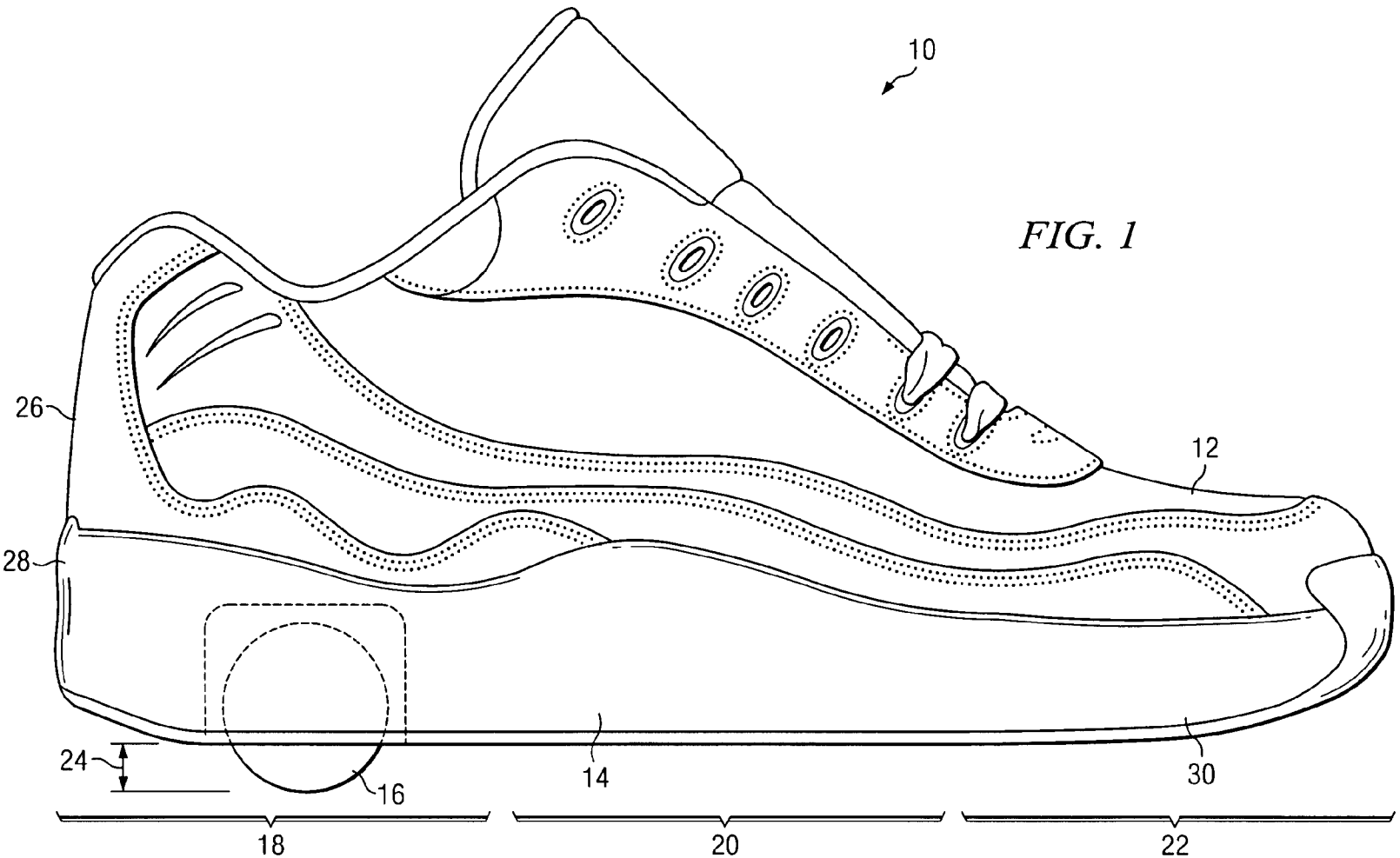
FIG. 1 is a side view that illustrates a motorized heeling apparatus implemented using an athletic shoe according to one embodiment of the present invention.

FIG. 1 is a side view of a motorized heeling apparatus 10 implemented using an athletic shoe 12 according to one embodiment of the present invention. The motorized heeling apparatus 10 preferably includes a wheel assembly provided in an opening in the heel portion of the sole of a footwear. For example the athletic shoe 12 includes an opening in the bottom of a heel portion 18 of a sole 14 with a wheel assembly provided in the hole such that a wheel 16 extends below the bottom of the sole 14. The wheel assembly preferably includes at least one wheel, such as the wheel 16, rotatably mounted on an axle (not illustrated in FIG. 1). The wheel 16 mounted on the axle is preferably positioned in the opening of the sole 14 through a mounting structure (not illustrated in FIG. 1) that is operable to support the axle such that a portion of the wheel 16 extends below the heel portion 18 of the sole 14.

The amount or length of the portion of the wheel 16 that extends below the bottom of the sole 14, as defined by a distance 24, will preferably be less than the diameter of the wheel 16. The distance 24, however, may be greater than, less than, or equal to the diameter of the wheel 16.

The athletic shoe 12, as is true of most footwear, may be generally described as having the sole 14 and an upper part 26. The upper part 26 may be constructed of virtually any material such as, for example, leather, plastic, or canvas. The sole 14 may include three parts: (1) an inner sole or insole (not illustrated in FIG. 1); (2) a midsole 28; and (3) an outer sole or outsole 30. The insole may provide added cushion and may or may not be removable. In some embodiments, the insole may include a removable portion, such as a DR. SCHOLL'S insole, and a portion that remains attached to the athletic shoe 12. The outsole 30 will preferably be made of a durable material, such as rubber, and may have a textured surface, such as with knobbies, to provide added traction. The midsole 28 will generally be constructed of a soft or "cushiony" material and will generally be thicker than the insole and the outsole 30. In some embodiments, however, the sole 14 will comprise only one part, such as the leather sole of a loafer. In other embodiments, the sole 14 may include a separate heel block or object that elevates the footwear, such as the heel of a leather wingtip dress shoe. This heel block or object may be considered to be part of the heel portion 18 of the sole 14. It should be understood that the present invention may be implemented in virtually any footwear, irrespective of the design or the make-up of the sole 14. Various styles of footwear and methods of making footwear are known in the art and are known by one of ordinary skill in the art. For example, U.S. Pat. Nos. 4,245,406, 5,319,869, 5,384,973, 5,396,675, 5,572,804, 5,595,004, and 5,885,500, which are hereby incorporated by reference for all purposes, provide various background information regarding various footwear and methods of making footwear.

In most footwear, including the athletic shoe 12, the sole 14 may also be divided into three portions or regions: (1) the heel portion 18, (2) an arch portion 20, and (3) a forefoot portion 22, as illustrated in FIG. 1. It should be understood that the heel portion 18, the arch portion 20, and the forefoot portion 22 of the sole 14 are incapable of being exactly defined and located, and that such portions vary from one footwear type to another. Thus, the location, the boundaries between, and the size of the heel portion 18, the arch portion 20, and the forefoot portion 22 of the sole 14 are only rough approximations.

It should also be understood that although the position of the opening in the bottom of the sole 14, and hence also the wheel 16, is preferably located in the heel portion 18 of the sole 14, such an opening may also be located at the boundary of the heel portion 18 and the arch portion 20, at the arch portion 20, or at virtually any other location on the sole 14. The opening in the bottom of the sole 14 may extend entirely through the sole 14, e.g., through the outsole, the midsole and the insole, or only partially through the sole 14, e.g., through the outsole, and a portion or all of the midsole.

The wheel 16 may be constructed or made of virtually any known or available material such as, for example, a urethane, a plastic, a polymer, a metal, an alloy, a wood, a rubber, a composite material, and the like. This may include, for example, aluminum, titanium, steel, and a resin. In other embodiments, the wheel may be mounted on an electric motor operable to rotate. Preferably, the material will be durable, provide quiet performance, and will provide a "soft" or "cushioning" feel. In one embodiment, the wheel 16 may be implemented as one or more precision bearings such that the precision bearing serves as the wheel 16 itself. In yet another embodiment, the wheel assembly may include a spring or suspension such as, for example, a leaf spring, to provide additional cushion or suspension when the wheel 16 contacts a surface and a force is applied to the athletic shoe 12 in the direction of the surface, such as when someone is wearing and walking in the motorized heeling apparatus 10. The spring is preferably provided as part of the mounting structure of the wheel assembly. In still another embodiment, the wheel 16 is provided as a two piece wheel with an inner core, such as a hard inner core, surrounded by an outer tire, such as a urethane tire.

Depending on the desired implementation, the wheel 16 and the axle may be removable from the wheel assembly. In such a case, a removable cover may be provided in the opening in the sole 14 to cover the opening so that debris and dirt does not enter the opening. The removable cover may be provided in virtually any available configuration readily ascertainable by one of ordinary skill in the art. In one embodiment of the removable cover, an axle portion of the removable cover fits and/or couples to the mounting structure in the same or similar manner that the axle in which the wheel 16 is mounted fits and/or couples to the mounting structure of the wheel assembly. A tool may also be provided to facilitate the removal of the axle and wheel 16. This tool will, preferably, be small and multi-functional to provide any other possible adjustments to the motorized heeling apparatus 10, such as a screw driver, a wrench, and the like. In other embodiments of the motorized heeling apparatus 10, the wheel 16 may be retractable into the opening in the sole 14. In this manner, the wheel 16 may be retracted into the sole 14 and, thus, will not extend below the bottom of the sole 14. This allows the motorized heeling apparatus 10 to function just like ordinary footwear, such as the athletic shoe 12.

Figure 13:
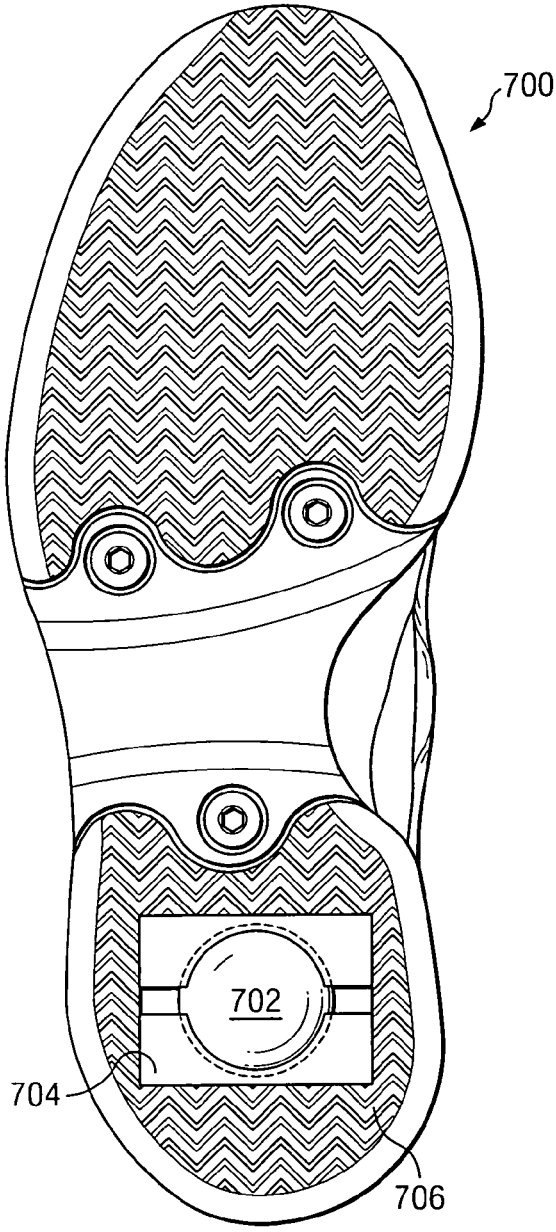
FIG. 13 is a bottom view that illustrates another embodiment of the present invention with a spherical ball serving as a wheel and positioned in a mounting structure in an opening in the heel portion of the sole.

In one embodiment of the present invention, the wheel assembly does not include an axle, and, arguably, not a mounting structure, and the wheel 16 is provided as a sphere, such as a stainless steel ball bearing, that is rotatably positioned in the opening in the bottom of the heel portion 18 of the sole 14, one embodiment of which is shown in FIG. 13. In another embodiment, the wheel assembly comprises an axle positioned completely through or partially through the heel portion 18 of the sole 14 such that the sole 14 supports the axle and the wheel is rotatably mounted on the axle in the opening of the sole 14. In this manner, the need for the mounting structure is eliminated.

Figure 12:
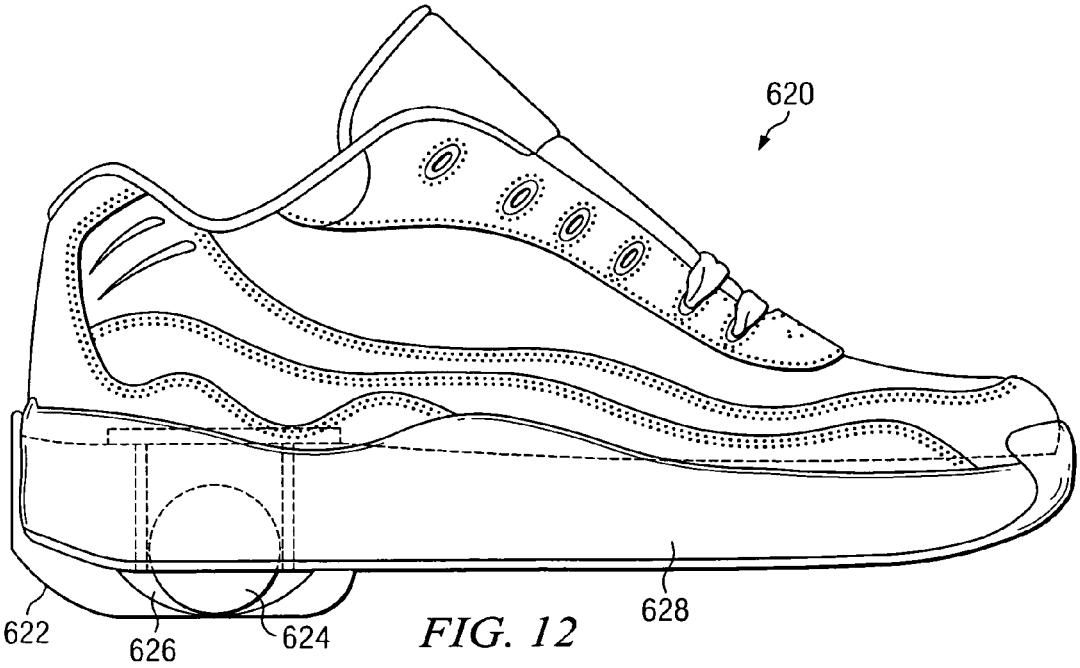
FIG. 12 is a side view of another embodiment that illustrates the motorized heeling apparatus of the present invention with a removable wheel cover positioned to cover the wheel and the opening in the sole.

In operation, and in one embodiment of the motorized heeling apparatus, a person wearing the motorized heeling apparatus 10 may either walk normally or roll on the wheel 16 by lifting or raising the sole 14 so that only or almost only the wheel 16 contacts a surface. This action may be referred to as "HEELING" or to "HEEL." The wheel 16, depending on the desired implementation of the present invention, may be removed or retracted to a position such that the wheel 16 does not extend below the bottom of the sole 14. This, generally, will result in the motorized heeling apparatus 10 performing like an associated footwear. When the wheel 16 is removed or retracted, a removable cover may be placed over the opening in the bottom of the sole 14 to prevent debris from entering the opening and potentially damaging the wheel assembly. In still other embodiments, a removable cover may be placed over the wheel 16 while a portion of the wheel 16 remains extended below the bottom of the sole 14 to assist with walking, an example of this is illustrated in FIG. 12.

It should be understood, however, that even if the wheel 16 is not removed or retracted as just described, the user may still comfortably walk and run, even with the wheel 16 extended. This generally occurs because the distance 24 can be minimal, which provides a unique "stealth" or "covert" aspect to heeling. This also results in the wheel rolling the opening or hole in the sole 14 of the motorized heeling apparatus 10. In one embodiment, the distance 24 is less than the radius of the wheel 16, which results in most of the wheel residing within the opening of the sole 14.

Figure 2A:
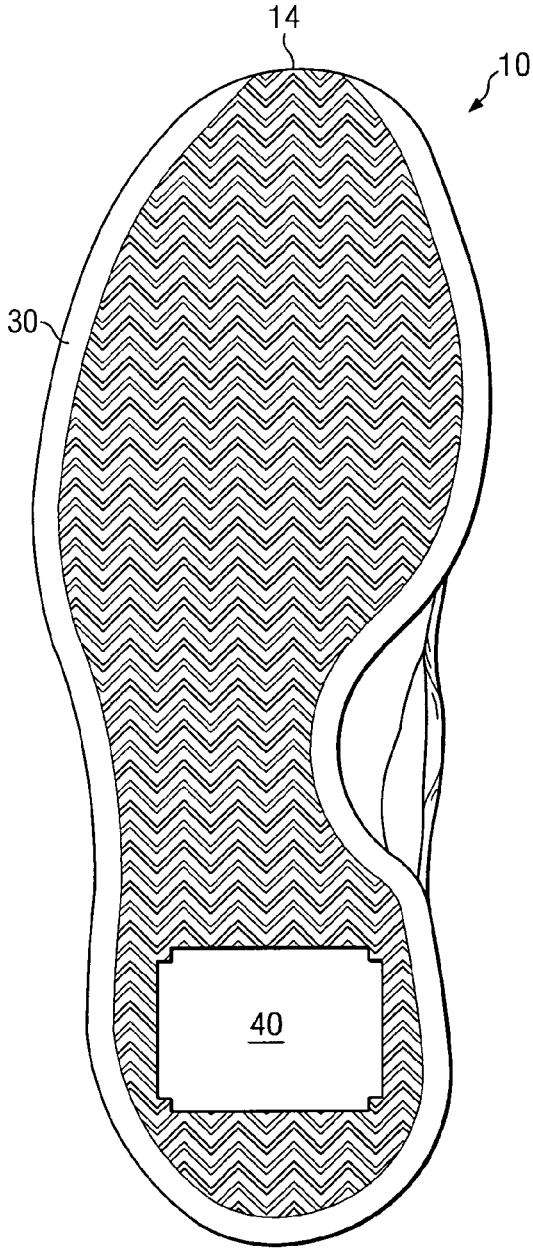
FIGS. 2A and 2B are bottom views that illustrate two embodiments of a sole of the motorized heeling apparatus with openings in the sole.
Figure 2B:
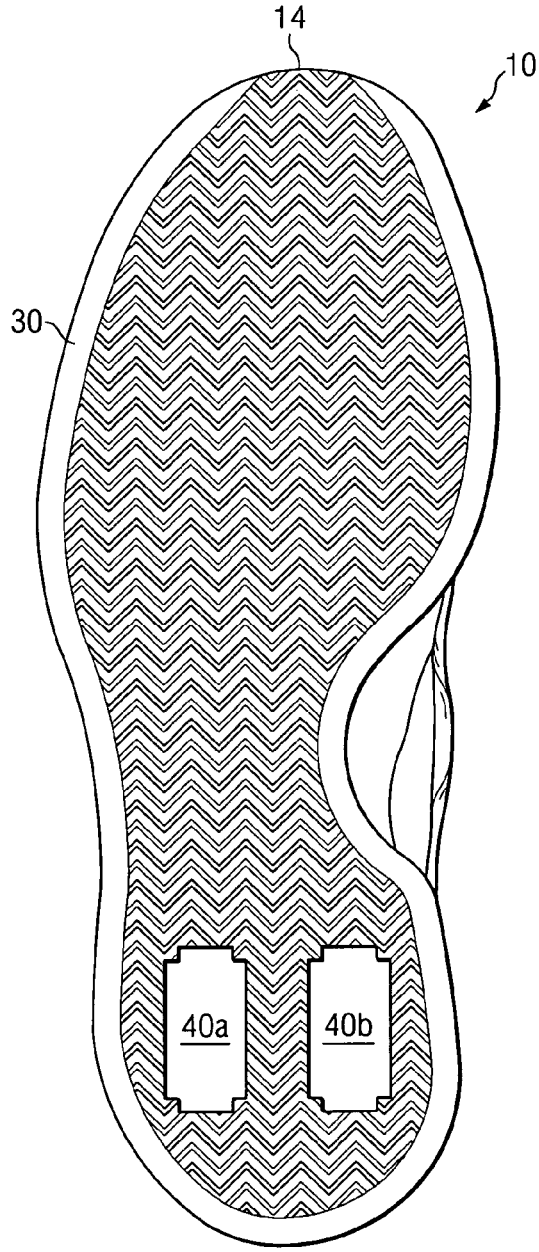

FIGS. 2A and 2B are bottom views of two embodiments of the sole 14 of the motorized heeling apparatus 10. In particular, the outsole 30 or bottom of the sole 14 is illustrated in FIG. 2A with an opening 40 in the heel portion 18 of the sole 14. In the embodiment illustrated, the opening 40 is provided in a square or rectangular configuration. The opening 40, however, may be provided in virtually any configuration, such as, for example, a circular or an elliptical configuration.

As mentioned previously, the opening 40 may extend partially or completely through the sole 14. The opening 40 may be provided through a heel block or object. Further, the opening 40 may be positioned in, near, or in a combination of the heel portion 18, the arch portion 20, and the forefoot portion 22.

FIG. 2B illustrates a second embodiment as to the placement and configuration of the opening 40. The outsole 30 is illustrated with an opening 40A and an opening 40B in the heel portion 18 of the sole 14. In this manner, one or more wheels, including one or more axles, may be positioned in both the opening 40A and 40B.

Figure 3A:
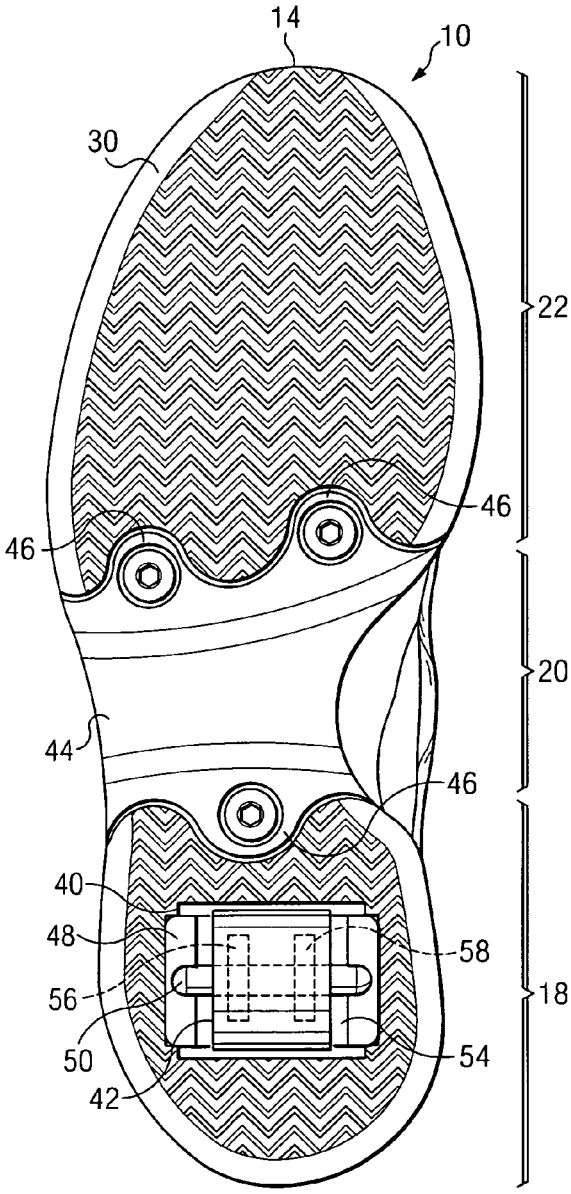
FIGS. 3A and 3B are bottom views of the two embodiments of the sole as shown in FIGS. 2A and 2B and illustrate a wheel in each of the openings of the soles.
Figure 3B:
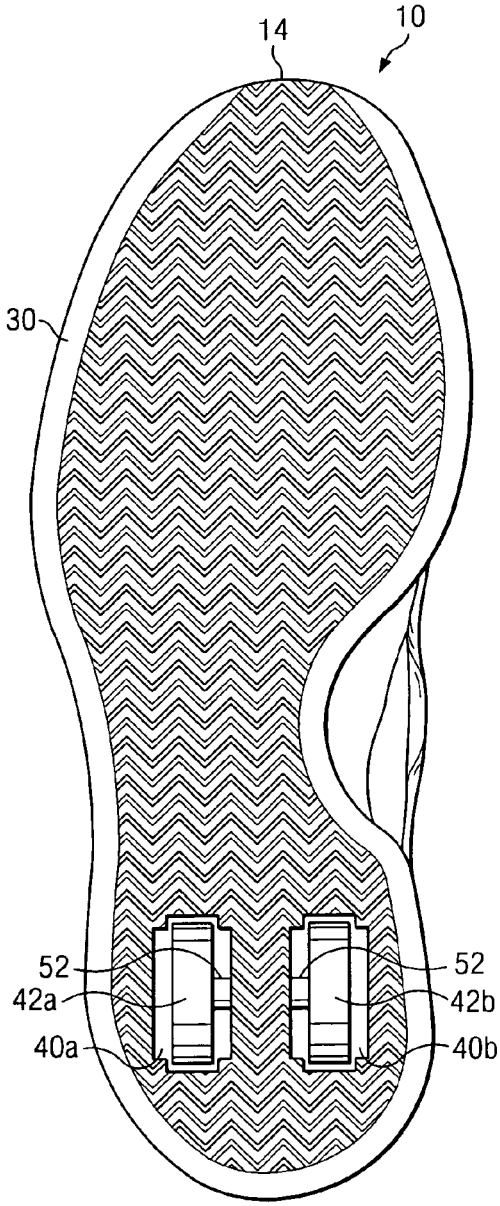

FIGS. 3A and 3B are bottom views of the two embodiments of the sole 14 as shown in FIGS. 2A and 2B and illustrate a wheel in each of the openings of the soles. This includes a wheel 42 positioned in the opening 40 in FIG. 3A and a wheel 42A and a wheel 42B in the openings 40A and 40B, respectively, of FIG. 3B.

The wheel 42 and the wheels 42A and 42B are illustrated as cylindrical wheels. These wheels, however, may be provided in virtually any available configuration. Further, one or more wheels may be positioned in each opening.

FIG. 3A further illustrates other elements of the wheel assembly that include a first member 48 and a second member 54 of a mounting structure that is used to removably couple with an axle 50. The axle 50 extends through the wheel 42 such that the wheel 42 is rotatably coupled or mounted to the axle 50. This preferably involves the use of precision bearings, such as high performance precision bearings, provided in a recess, such as an annular recess, on either side of the wheel 42. A first precision bearing 56 and a second precision bearing 58 may be ABEC grade precision bearings and are illustrated with hidden lines and positioned in the first recess and second recess of the wheel 42. In alternative embodiment, loose ball bearings may be used.

The axle 50 may be made of any material that provides suitable physical characteristics, such as strength and weight, to name a few. The axle 50 is preferably made of hardened steel, is cylindrical in shape, each end is rounded, and is removably coupled with a first member 48 and a second member 54, respectively, of the mounting structure. The removable coupling between each end of the axle 50 and the first member 48 and the second member 54 may be achieved by any known or available mechanism. In a preferred embodiment, a sphere or a ball bearing, preferably using a moveable spring and/or a screw bias, is used to contact and exert a side wall force between one or members of the mounting structure and the axle 50.

It should also be noted that because the weight of the user of the motorized heeling apparatus 10 will exert a significant downward force and the ground or surface will exert an equal force upward, the axle 50, and, hence, the wheel 42 will generally be forced into place. Only when the heel is raised from a surface will any force or friction be required to keep the axle 50 in place. Thus, the present invention does not require a large side force to keep the axle 50 and the wheel 42 in place. The recognition of this fact may be considered an aspect of the present invention for the embodiment as shown. This recognition allows the removable coupling between each end of the axle 50 and the first member 48 and the second member 54 to be optimally designed.

FIG. 3A also illustrates a grind plate 44 (which also may be referred to as a slide plate 44) that may be used in conjunction with the motorized heeling apparatus 10 of the present invention. In one embodiment, a battery, not specifically shown in FIG. 3A, may be integrated or stored in the arch portion of the footwear to provide a convenient location for power to the electric motor, not visible in FIG. 3A. The grind plate 44 provides a smooth or relatively smooth surface to allow a user to "grind" or "slide" on various surfaces such as hand rails, curbs, steps, corners, and the like. The grind plate 44 is preferably somewhat thin and made of a plastic or polymer material. In a preferred embodiment, the grind plate 44 is removably attached to the arch portion 20 of the outsole 30 of the sole 14. The grind plate 44 may be attached using any known or available fastener, such as, for example, a fastener 46 shown in various locations around the periphery of the grind plate 44.

FIG. 3B further illustrates an axle 52 in which the wheel 42A and the wheel 42B are coupled to either end in the opening 40A and the opening 40B, respectively. The axle 52 extends through both the wheels 42A and 42B and through a portion of sole 14, not visible in FIG. 3B. This serves to support the axle 52 and illustrates the situation where the sole 14 serves as the mounting structure of the wheel assembly. This reduces the overall number of parts. In an alternative embodiment, a metal or some other suitable material may be used within the heel portion 18 of the sole 14 where the axle 52 is positioned to provide additional support and stability. This is an example where the mounting structure is, in effect, integrated into the sole 14. As can be appreciated by one skilled in the art, the present invention may be implemented in any number of ways.

Figure 4:
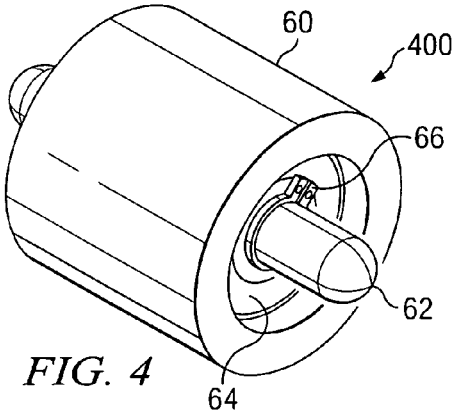
FIG. 4 is a perspective view that illustrates a wheel rotatably mounted to an axle, which also may be referred to as a wheel/axle assembly, for use in a wheel assembly according to one embodiment of the present invention.

FIG. 4 is a perspective view of a wheel 60 rotatably mounted on an axle 62, which also may be referred to as a wheel/axle assembly, for use in a wheel assembly, or in a motorized heeling apparatus, according to one embodiment of the present invention. The wheel 60 and the axle 62 may also be referred to as a wheel/axle assembly 400. In this embodiment, the axle 62 extends through the wheel 60 and includes two ends that are rounded or bullet shaped. A precision bearing 64 is shown positioned in a recess, which is shown as an annular recess, of the wheel 60 to facilitate the rotation of the wheel 60 around the axle 62. Preferably a second precision bearing is positioned in a second recess, not shown in FIG. 4, to further facilitate such rotation.

A slip clip, slip ring, or ring clip 66 is shown positioned around, or nearly around, the axle 62 near the precision bearing 64. This serves to ensure that the precision bearing 64 remains in place in the recess of the wheel 60. The slip clip or ring clip 66 will preferably be positioned on the axle 62 through a groove, such as a radial groove or radial indentation, in the axle 62. It should be understood, however, that one of ordinary skill in the art may use any of a variety of other arrangements to ensure that the precision bearing 64 stays in position. In alternative embodiments, the precision bearing 64 may be eliminated or loose bearings may be used.

The wheel 60 rotatably mounted on the axle 62 may, in alternative embodiments, serve as the wheel assembly of the present invention. In such a case, the axle 62 may be mounted to the sole, such as the midsole and heel portion, at its ends while the wheel 60 is rotatably provided in the opening of the sole. In this manner, the need for a mounting structure may be thought of as eliminated or, alternatively, the mounting structure may be thought of as integrated into the sole of the footwear.

Figure 5:
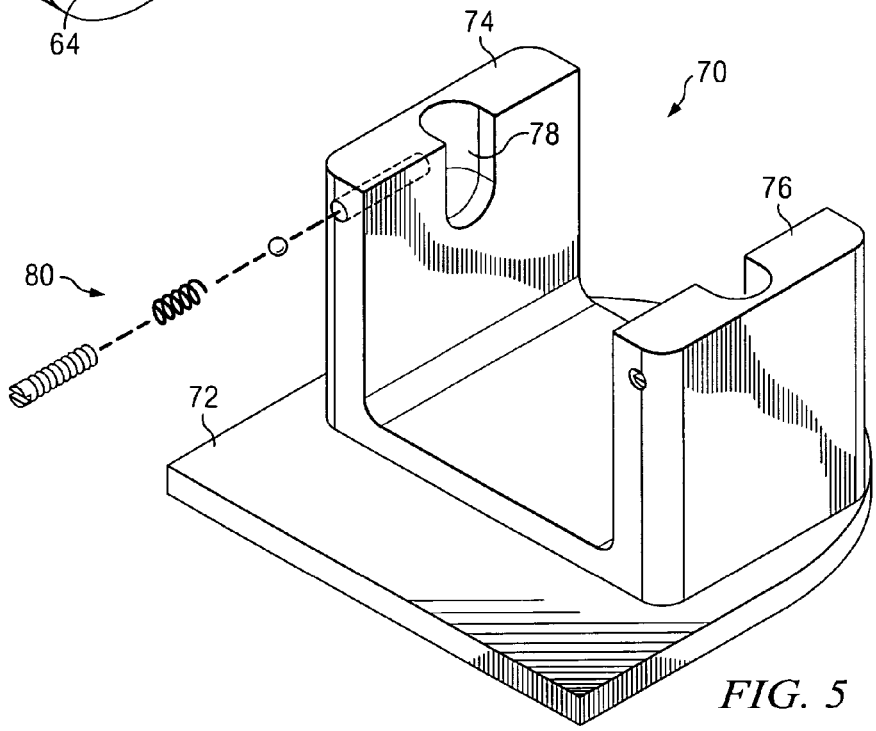
FIG. 5 is a perspective view that illustrates a mounting structure for use with a wheel rotatably mounted to an axle, as illustrated in FIG. 4, to form a wheel assembly.

FIG. 5 is a perspective view of a mounting structure 70 for use with a wheel rotatably mounted to an axle, such as is illustrated in FIG. 4, to form a wheel assembly. The mounting structure 70 generally includes a heel control plate 72, a first member 74, and a second member 76. In alternative embodiments, a spring, such as a leaf spring, could be provided where the two members contact the heel control plate 72. This would provide the added benefit of greater cushion and suspension. The two members include an opening, such as the opening 78 of the first member 74 to receive an end of an axle. It should be mentioned that the opening may be provided in virtually any configuration, including extending through the member, or placed at different positions, or even multiple positions for mounting the wheel/axle assembly 400 at a retractable position and an extended position, on the member.

The axle that is to be positioned in the openings of the first member 74 and the second member 76 will preferably be removably coupled. This may be achieved by any number of arrangements and configurations, all of which fall within the scope of the present invention. One such arrangement is the screw/spring/ball bearing arrangement 80 provided in first member 74. This arrangement provides an adjustable bias or force that can be exerted against the axle when it is inserted into the opening 78. The screw is accessible and adjustable by the user. The turning of the screw affects the compression of a spring which, in turn, provides a force on a ball bearing that extends out into the opening 78. When the axle is inserted into the opening 78, the ball bearing may be displaced an amount and the screw/spring/ball bearing arrangement 80 will provide a side force to allow the axle to be secure, yet removable. A similar arrangement may also be provided in the second member 76 to provide a friction fit or coupling on the other end of the axle 62.

Figure 6:
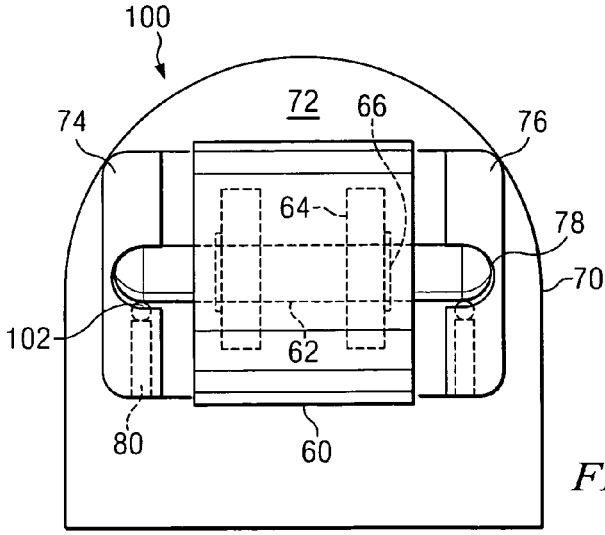
FIG. 6 is a bottom view that illustrates a wheel assembly that includes the wheel rotatably mounted on the axle as shown in FIG. 4 and the mounting structure of FIG. 5.

Although the screw/spring/ball bearing arrangement 80 of FIG. 5 is shown being implemented through a horizontal opening in the first member 74, it may be implemented in using an opening aligned in virtually any manner in the member. For example, the adjustment of the tension or pressure on the screw/spring/ball arrangement 80 may be achieved through a diagonal opening such that the exposed end of the screw/spring/ball arrangement 80, normally a screw head end, is provided where the reference line for numeral 74 in FIG. 5 contacts the first member 74. This provides easier access to adjust the tension and friction fit on the axle 62 when the wheel assembly, such as wheel assembly 100 of FIG. 6, is engaged or positioned within the opening of a sole to form a motorized heeling apparatus. Of course, any of a variety of other arrangements, configurations, and opening alignments may be contemplated and implemented under the present invention.

The mounting structure 70 can be made or constructed of virtually any material, generally depending on the desired mechanical characteristics such as, for example, rigidity and strength. These materials may include, for example, a plastic, a polymer, a metal, an alloy, a wood, a rubber, a composite material, and the like. This may include aluminum, titanium, steel, and a resin. In one embodiment, the mounting structure 70 is made of a metal, such as aluminum, that has been anodized such that the mounting structure 70 presents a black color or hue.

FIG. 6 is a bottom view of a wheel assembly 100 that includes the wheel 60 rotatably mounted to the axle 62, as shown in FIG. 4, and the mounting structure 70 of FIG. 5. The first member 74 and the second member 76 each removably couple with the ends of the axle 62 through a bias mechanism implemented using a bias mechanism, such as the screw/spring/ball bearing arrangement 80. A ball bearing 102 is shown contacting one end of the axle 62 in the opening 78. Further slip clips or ring clips (which may also be referred to as snap rings or slip rings), such as ring clip 66, are provided to ensure that the precision bearings positioned in the recesses of the wheel remain in position.

In other embodiments of a motorized heeling apparatus, it is advantageous to use a sprag clutch between the wheel and the axle. For example, the precision bearing 64 may be implemented as a sprag clutch. A sprag clutch, in effect, may be thought of as one-way bearing that allows the wheel to rotate freely around the axle in a forward direction when the axle is not rotating, while also allowing the axle to rotate in a forward direction to also rotate the wheel with the axle. In such an arrangement, the axle may be rotated by an electric motor to also rotate the wheel in a forward direction, yet the wheel is free to roll freely in the forward direction when the electric motor is not rotating the axle. This allows passive rolling, i.e., when the electric motor is not engaged, and electric powered rolling when the electric motor is energized and rotating the axle and thus the wheel.

The heel control plate 72 allows the user of the motorized heeling apparatus to gain greater control and to obtain greater performance out of the motorized heeling apparatus.

Figure 7:
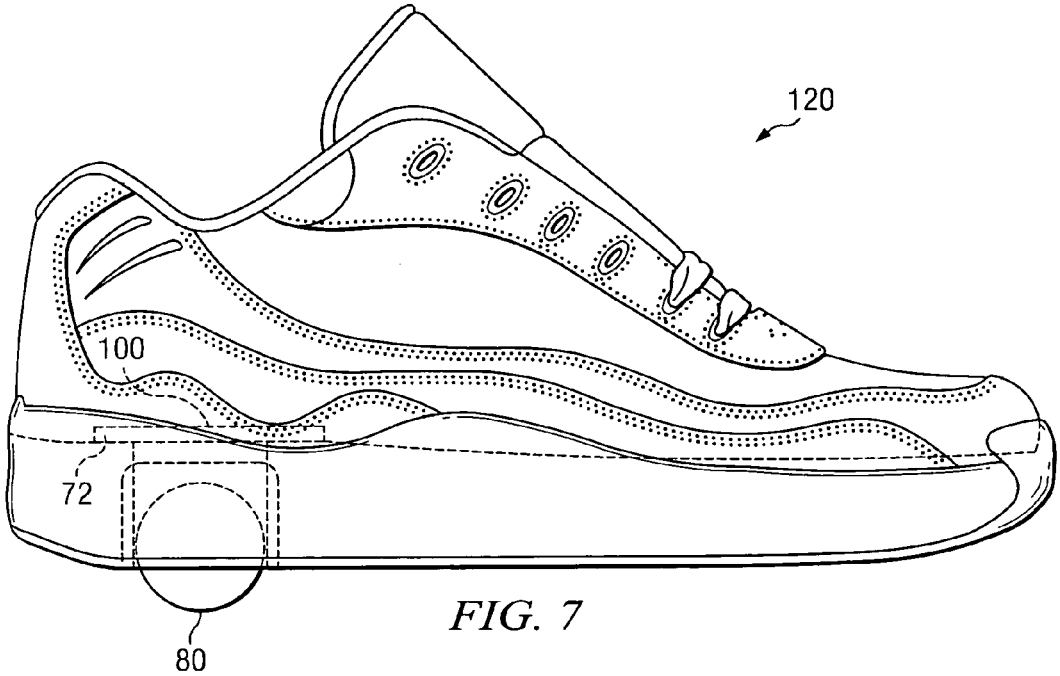
FIG. 7 is a side view that illustrates the wheel assembly positioned above and through the opening in a footwear to form a motorized heeling apparatus.

FIG. 7 is a side view of the wheel assembly 100 positioned above and through the opening to form a motorized heeling apparatus 120. The heel control plate 72 resides inside the shoe so that the heel of the user may apply pressure to the heel control plate as desired to provide better handling and performance of the motorized heeling apparatus 120.

Figure 8A:
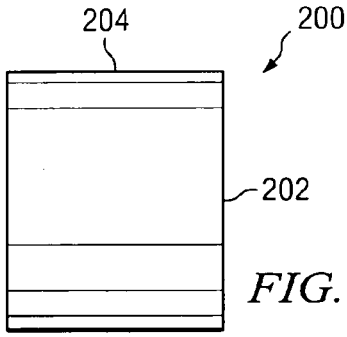
FIGS. 8A, 8B, 8C, and 8D are profile views of various wheels that illustrate the surface profile of these wheels that may be used in various embodiments of the present invention.
Figure 8B:
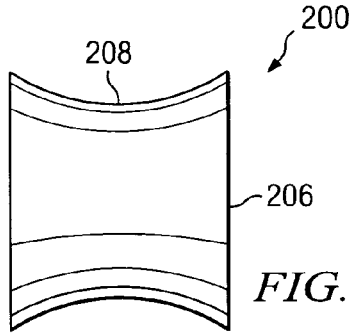
Figure 8C:
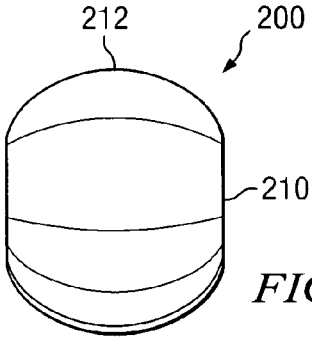
Figure 8D:
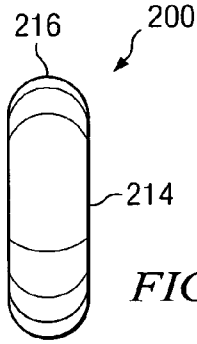

FIGS. 8A, 8B, 8C, and 8D are profile views of various wheels 200 that illustrates the surface profile of these wheels that may be used in various embodiments of the present invention. In FIG. 8A, a wheel 202 is shown with a flat or square surface or exterior profile 204. In FIG. 8B, a wheel 206 is shown with an inverted surface profile 208. In FIG. 8*c*, a wheel 210 is shown with round surface profile 212. Finally, in FIG. 8D, a wheel 214 is shown with a steep surface profile 216. The present invention may incorporate virtually any available surface profile of a wheel.

Figure 9:
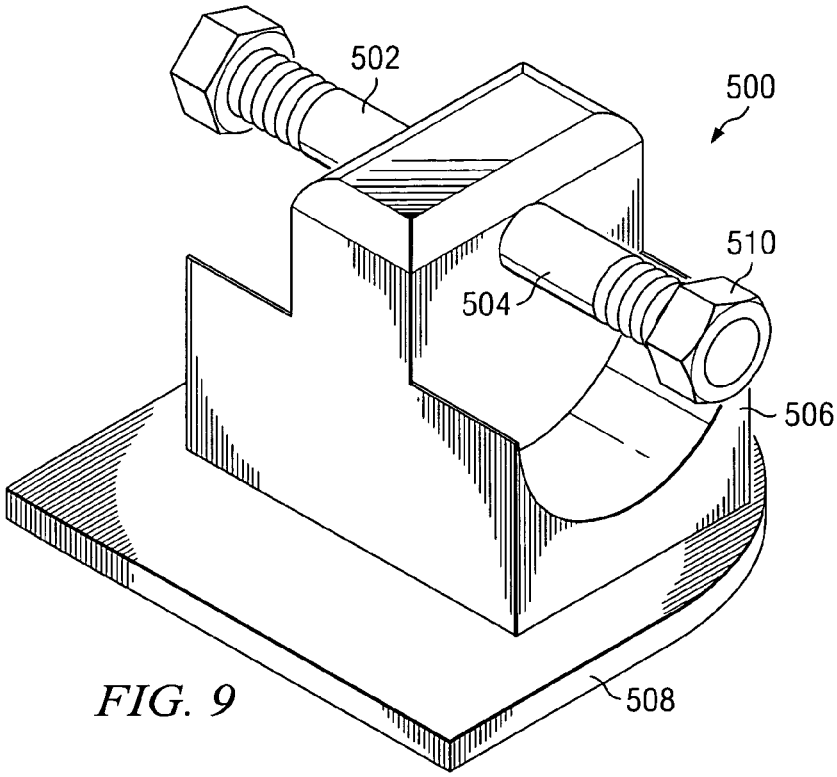
FIG. 9 is a perspective view that illustrates a mounting structure of another embodiment for use in a wheel assembly of a motorized heeling apparatus.

FIG. 9 is a perspective view that illustrates a mounting structure 500 of another embodiment for use in a wheel assembly of a motorized heeling apparatus. The mounting structure 500 includes an axle 502, which may be considered one axle that extends through and is mounted through a member 50 or as an axle 502 that couples with the member 506 along with an axle 504 that couples with the member 506 opposite axle 502. The mounting structure 500 also includes a heel control plate 508 coupled with the member 506.

The mounting structure 500 allows for two wheels to be mounted to form a wheel assembly. A wheel may be rotatably mounted on the axle 502, preferably using a precision bearing, and a wheel may be rotatably mounted on the axle 504, also preferably through a precision bearing as illustrated previously herein.

Figure 10:
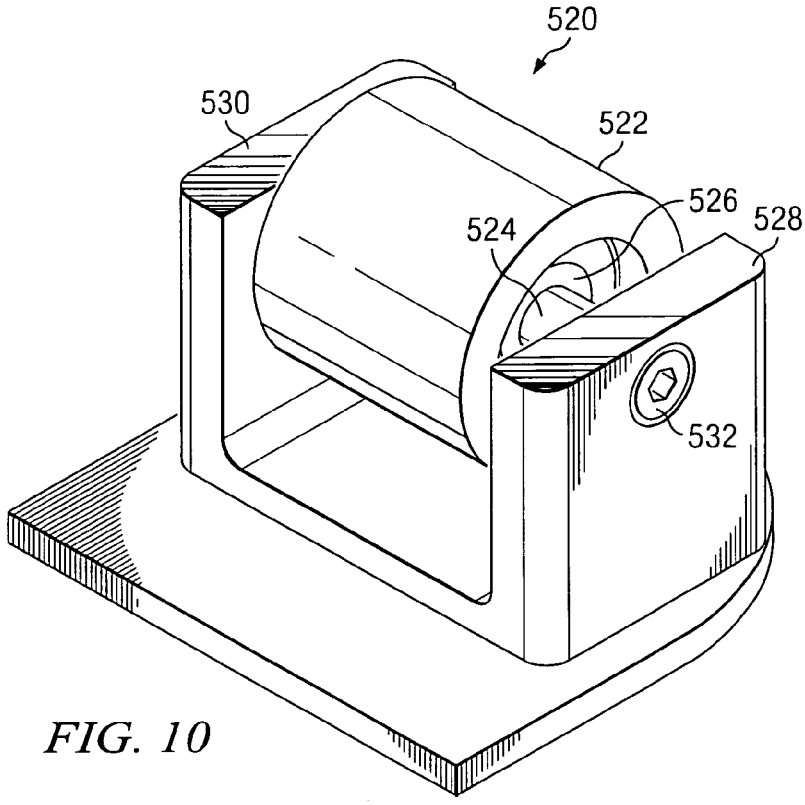
FIG. 10 is a perspective view that illustrates a wheel assembly that uses yet another embodiment for use in a motorized heeling apparatus.

The axle 502 and the axle 504 include a threaded portion such that a nut, such as a lock nut 510 may be included to secure a wheel to each axle. In other embodiments, the end of the axles may include internal threads, as opposed to external threads as shown, so that a screw, such as the hex screw as shown in FIG. 10. It should be understood that virtually any available coupling may be provided between the axle and the member.

FIG. 10 is a perspective view that illustrates a wheel assembly 520 that uses yet another embodiment for use in a motorized heeling apparatus and includes a wheel 522 rotatably mounted to an axle 524 using a precision bearing 526, and a first member 528 and a second member 530 coupled to each end of the axle 524 through a screw, such as hex screw 532. The wheel assembly 520 is similar to wheel assembly 100, which was described above in connection with FIG. 6, except that the wheel/axle assembly cannot be as easily inserted and removed.

Figure 11:
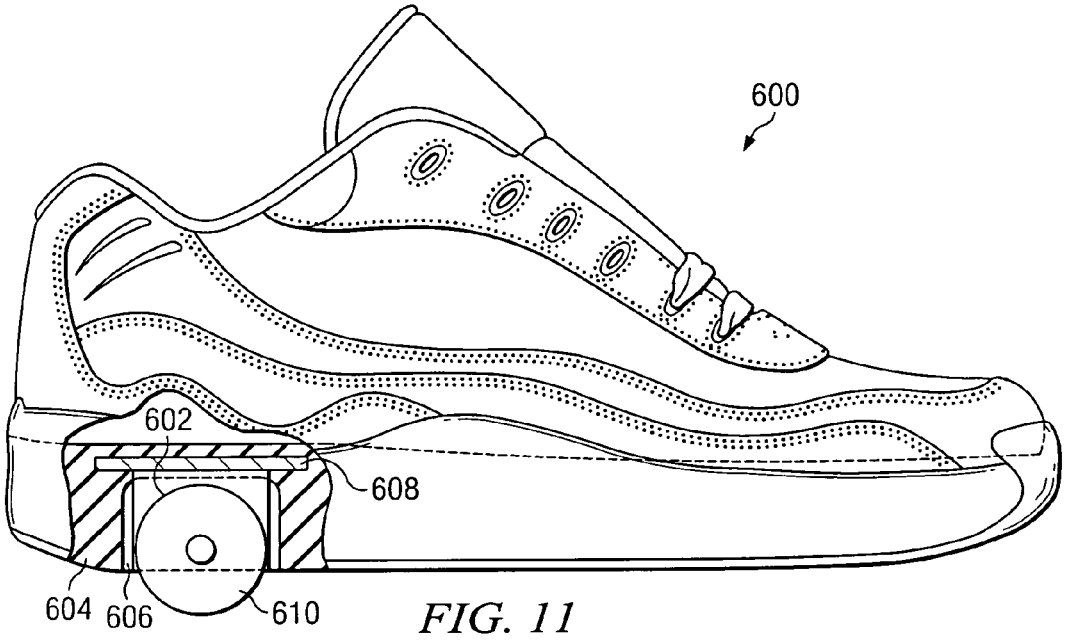
FIG. 11 is a side, partial cutaway view that illustrates one embodiment of a motorized heeling apparatus that illustrates the wheel assembly provided in the sole of the motorized heeling apparatus and the opening in the sole not extending completely through the sole.

FIG. 11 is a side, partial cutaway view that illustrates one embodiment of a motorized heeling apparatus 600 that illustrates a wheel assembly 602 provided in a sole 604 and an opening 606 in the sole 604 that does not extend completely through the sole 604. As such, the mounting structure 608 may be provided or integrated into the sole 604 and may not be readily or easily removed. A wheel 610 is also shown extending partially below the bottom of the sole 604, which provides the advantage of stealth heeling.

FIG. 12 is a side view of another embodiment that illustrates a motorized heeling apparatus 620 of the present invention with a removable wheel cover 622 positioned to cover a wheel 624 and an opening 626 in a sole 628. The removable wheel cover 622 allows for the wheel to be provided in an extended position, i.e., below the bottom surface of the sole 628, yet not engage a surface to roll. Although the motorized heeling apparatus 620 of the present invention allows a user to walk and run, even with the wheel in an engaged position, the removable wheel cover 622 provides protection from dirt and debris and provides greater stability.

In an alternative embodiment, a wheel stop, not expressly shown in FIG. 12, may be provided, in lieu of or in conjunction with the removable wheel cover 622, to stop the rotation of the wheel 624. In one embodiment, the wheel stop is made of virtually any material, such as a sponge or flexible material, that can be wedged between the wheel 624 and the opening 626 to stop or prevent the rotation of the wheel 624 and to stay in place through friction.

In other embodiments of the wheel cover 622, a wheel cover is provided when the wheel 624 has been removed from the motorized heeling apparatus 620. In a preferred embodiment, this wheel cover is generally flush with the remainder of the bottom of the sole 628, and, hence, provides the function of a regular shoe when desired and protects the opening. This wheel cover may couple in any available manner, but preferably will couple to the wheel assembly in the same or similar manner that the wheel/axle assembly couples to the mounting structure. The removable wheel cover could clip or attach to the wheel assembly in many different ways.

FIG. 13 is a bottom view that illustrates another embodiment of a motorized heeling apparatus 700 with a spherical ball 702 serving as a wheel and positioned in a mounting structure 704 in an opening in the heel portion of the sole 706.

Figure 14:
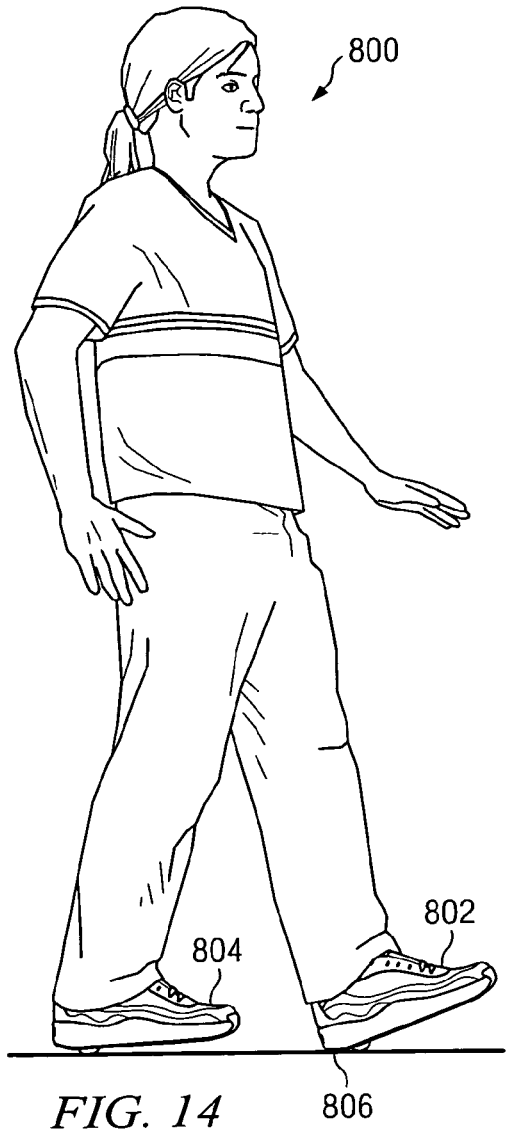
FIG. 14 is a perspective view that illustrates a "heeler" using the present invention to "heel"

FIG. 14 is a perspective view that illustrates a "heeler" 800 using an embodiment of a motorized heeling apparatus to "heel." Heeling can be achieved using various techniques and, generally, requires a skill set of balance, positioning, flexibility, and coordination.

An illustrative method for using a motorized heeling apparatus on a surface may include running on a surface by using a forefoot portion of a sole of the motorized heeling apparatus to contact the surface, which may be referred to as a non-rolling mode, and then rolling on the surface with a wheel of the motorized heeling apparatus extended below the bottom of the sole through an opening in the sole by using a wheel of the motorized heeling apparatus to contact the surface. This may be referred to as "passive rolling mode" because rolling takes place, but the electric motor has not yet been engaged or utilized to propel the wheel. Before running on a surface, the method may include walking on the surface, also a non-rolling mode, while wearing the motorized heeling apparatus with a wheel of the motorized heeling apparatus extended below the bottom of a sole portion of the motorized heeling apparatus before running on the surface.

Preferably, after the passive rolling mode, and while stable and still rolling on the one or more wheels in the heel, the user uses a throttle, not expressly shown, to engage the electric motor, which is coupled to the wheel, to provide additional forward rotation to the wheel. The throttle is preferably a wireless throttle, but can be implemented as a "wired" throttle to control the amount of electrical power sent to the motor, which controls the speed of the rotation of the motor, and hence the wheel.

The method of heeling may also include engaging the wheel of the motorized heeling apparatus to extend below the bottom of the sole portion of the motorized heeling apparatus before walking on the surface. The method may also include walking on the surface while wearing the motorized heeling apparatus before engaging the wheel of the motorized heeling apparatus and with the wheel of the motorized heeling apparatus retracted. Other variations on the method may include transitioning from rolling on the surface to either running, walking, or stopping on the surface by running on the surface through using the forefoot portion of the sole of the motorized heeling apparatus to contact the surface just after rolling on the surface.

The preferred position while heeling is illustrated by the heeler 800 in FIG. 14 where one motorized heeling apparatus 802 is placed in front of the other motorized heeling apparatus 804 while rolling on a surface. As can be seen from a back heel portion 806 of the motorized heeling apparatus 804, sometimes the clearance between the back heel portion 806 and the surface is small. As a result, in a preferred embodiment, the back heel portion may implement any number of techniques for slowing or stopping. For example, rolling may be slowed by contacting the forefoot portion of the sole of the motorized heeling apparatus to contact the surface to create friction and to remove the wheel from the surface. Another example includes slowing by contacting a heel portion of the sole of the motorized heeling apparatus to contact the surface.

Figure 15:
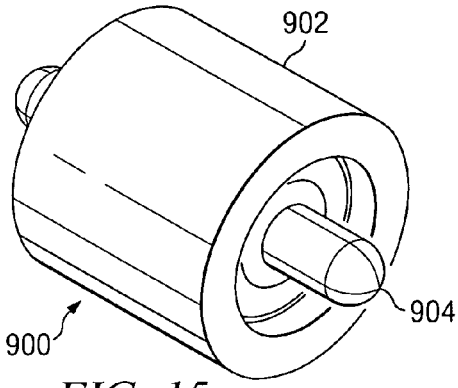
FIG. 15 is a perspective view that illustrates a wheel rotatably mounted to an axle, which also may be referred to as a wheel/axle assembly, similar to FIG. 4.
Figure 16:
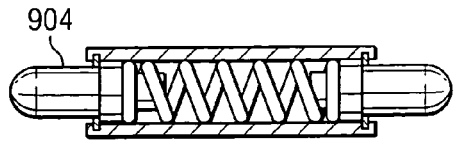
FIG. 16 is a cutaway view that illustrates a collapsible axle of the wheel/axle assembly of FIG. 15 implemented as a spring loaded collapsible axle.

FIG. 15 is a perspective view that illustrates a wheel 902 rotatably mounted to a collapsible axle 904, which also may be referred to as a wheel/axle assembly 900, similar to FIG. 4. The collapsible axle 904 may be implemented in any number of ways, such as an adjustable axle that is spring loaded, similar to what is shown in FIG. 16, or as a screw collapsible axle. This allows the wheel/axle assembly 900 to be more easily removable and/or retractable to a position where the wheel would not engage the ground if the wheel/axle assembly 900 were implemented in a motorized heeling apparatus.

FIG. 16 is a cutaway view that illustrates a collapsible axle 904 of the wheel/axle assembly 900 of FIG. 15 implemented as a spring loaded collapsible axle. As can be seen, the collapsible axle 904 may be adjusted or shortened by inwardly compressing both ends of the collapsible axle 904 to overcome the internal spring force.

Figure 17:
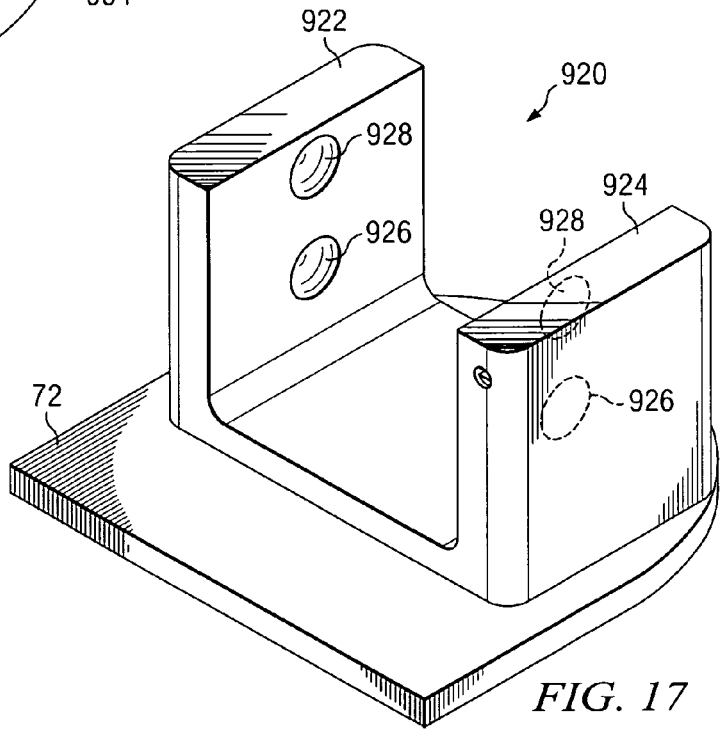
FIG. 17 is a perspective view that illustrates another mounting structure for use with the wheel/axle assembly and the collapsible axle, as illustrated in FIG. 15 and FIG. 16, to form a wheel assembly.

FIG. 17 is a perspective view that illustrates another mounting structure 920 for use with the wheel/axle assembly 900 and the collapsible axle 904, as illustrated in FIG. 15 and FIG. 16, respectively, to form a wheel assembly. The collapsible axle 904 may couple to a first member 922 and a second member 924 at a first position 926 at the first member 922 and the second member 924 so that the wheel is in a retracted position. The collapsible axle 904 may also couple to the first member 922 and the second member 924 at a second position 928 so that the wheel is in an extended position.

Figure 18:
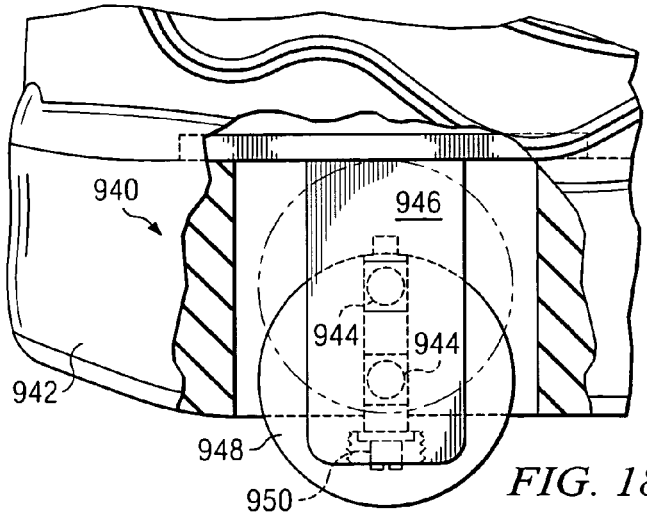
FIG. 18 is a side, cutaway view that illustrates a wheel assembly positioned through an opening in a sole that illustrates one embodiment of an axle that couples to the mounting structure to provide a retractable wheel using an assembly that may be referred to as a king pin arrangement.

FIG. 18 is a side, cutaway view that illustrates a wheel assembly 940 positioned through an opening in a sole 942 that illustrates one embodiment of an axle 944 that couples to a mounting structure 946 to provide a retractable wheel 948 using an assembly that may be referred to as a king pin arrangement or dual king pin arrangement. This allows the retractable wheel 948 to be adjusted up or down, as desired, and from a retractable position to an extended position. A king pin 950 (which may be implemented as a threaded screw or bolt) is shown threadingly engaged in a threaded opening in a member of the mounting structure 946. As the king pin 950 is screwed further into the opening in the member, the axle 944 is further retracted. A king pin 950 will also be provided at the other member to raise the other side of the axle 944. In other embodiments, such as the mounting structure 500 in FIG. 9, a single king pin could be provided through the single member to provide retractable wheels through the coupling of the members and the axle.

An example of a king pin type assembly is illustrated in U.S. Pat. No. 4,295,655, which is incorporated herein by reference for all purposes, issued to David L. Landay, et al., was filed on Jul. 18, 1979, was issued Oct. 20, 1981. This patent illustrates a king pin type assembly that could be implemented in an embodiment of the present invention.

FIG. 19 is a bottom view that illustrates the wheel assembly 940 of FIG. 18 and further illustrates the dual king pin arrangement and the king pins 950 through the members of the mounting structure 946.

FIG. 20 is a side view that illustrates one member of the mounting structure 946 and further illustrates the coupling of the axle 944 to the mounting structure 946 using the dual king pin arrangement similar to FIG. 18. As discussed above, this allows the axle 944, and hence the attached wheel, to be transitioned to any of a desired levels, and from a retracted position to an extended position.

It should be understood that the axle may couple to a member of a mounting structure using any available technique and in virtually an unlimited number of ways. For example, an axle may couple to the first member and the second member of a mounting structure to move from a retracted position to an extended position through a spring arrangement. Similarly, an axle may couple to the first member and the second member of a mounting structure to move from a retracted position to an extended position through a hinged arrangement.

Many other examples are possible, for example U.S. Pat. No. 3,983,643, which is incorporated herein by reference for all purposes, issued to Walter Schreyer, et al., was filed on May 23, 1975, was issued Oct. 5, 1976 illustrates a retractable mechanism that may be implemented in one embodiment of the present invention. U.S. Pat. No. 5,785,327, which is incorporated herein by reference for all purposes, issued to Raymond J. Gallant, was filed on Jun. 20, 1997, issued on Jul. 28, 1998 illustrates simultaneously retractable wheels.

FIG. 21 is a breakaway and perspective view that illustrates a two piece wheel 970 that includes an inner core 972, an outer tire 974, such as a urethane wheel, an axle 976 (which may not be shown to skill), and a bearing 978 that may be used in the present invention. In a preferred embodiment, the bearing 978 is small in comparison to the two piece wheel 970, for example, the bearing 978 may have an outer diameter that is less than half the outer diameter of the outer tire 974. This can provide significant advantages, that include a softer ride, better control, and are longer lasting. This is because the outer tire 974 can be larger and thicker. In other embodiments, the bearing 978 is larger and has an outer diameter that is more than half the outer diameter of the outer tire 974. In a preferred embodiment, the inner core portion of the two piece wheel is made of a harder material that provides rigidity for enhanced bearing support, while the outer tire portion is made of a softer material, such as a soft urethane, for improved performance and a quieter ride. These types of wheels may be referred to as a "dual durometer" type wheel.

As mentioned previously, a "sprag clutch" arrangement is preferred in the coupling or mounting between the axle 976 and the wheel or outer tire 974 in certain implementations of motorized transportation apparatus.

Figure 22:
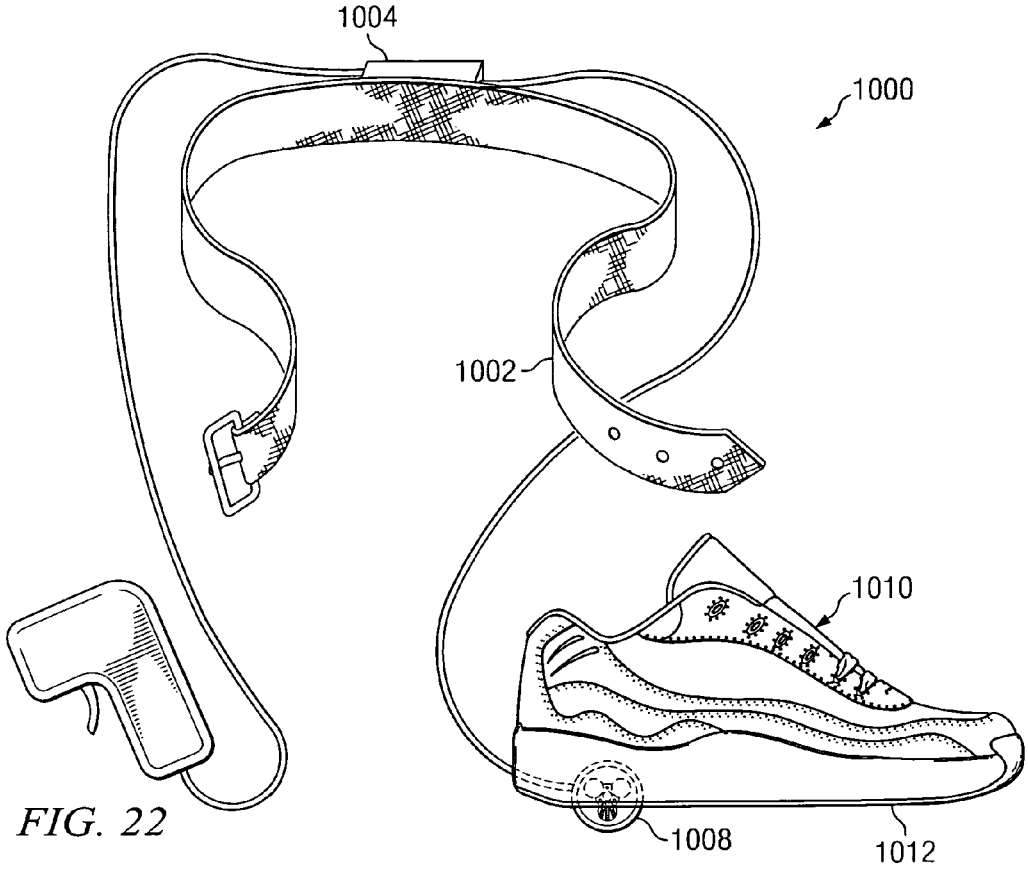
FIG. 22 is a perspective view that illustrates a motorized heeling apparatus that may be used in the present invention.

FIG. 22 is a perspective view that illustrates a motorized heeling apparatus 1000 that may be used in the present invention. The motorized heeling apparatus includes a belt 1002, which includes batteries 1004, a wired throttle 1006 to control a motorized wheel assembly 1008 positioned in a heel opening of the footwear 1010. The throttle 1006 will normally include circuitry, such as a speed controller, to control the amount of electrical power or energy provided to the motorized wheel assembly 1008. In this manner, a user may walk on the forefoot 1012 of the footwear 1010, transition weight to the heel of the footwear 1010 to, in one embodiment, passively roll on the wheel of the motorized wheel assembly 1008(in certain embodiments), and then provide electrical powered rolling by providing electrical power to the motor in the motorized wheel assembly 1008.

Figure 23:
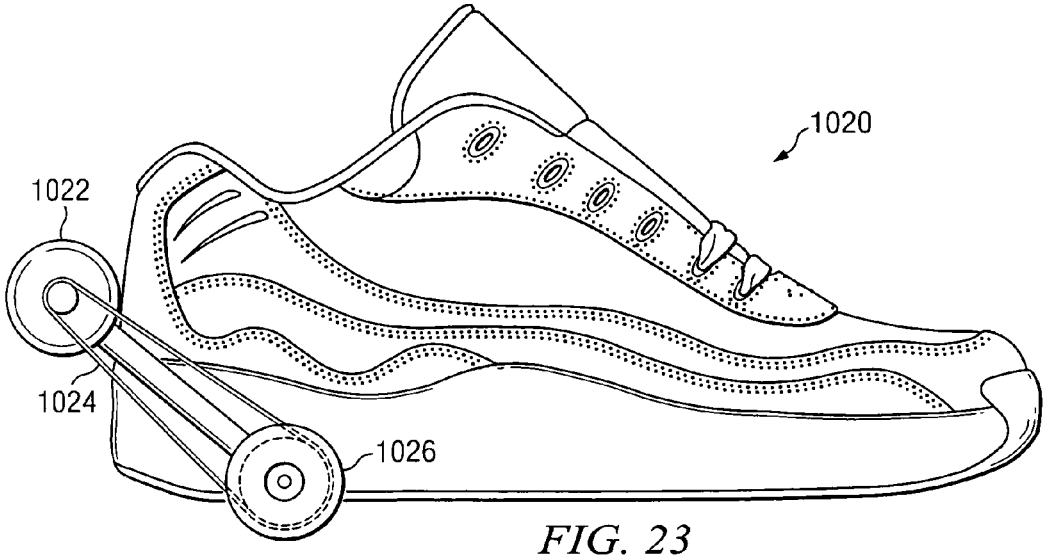
FIG. 23 is a side perspective view that illustrates a motorized heeling apparatus with a back mounted dc motor according to one aspect of the present invention.

FIG. 23 is a side perspective view that illustrates a motorized heeling apparatus 1020 with a back mounted dc motor 1022 according to one aspect of the present invention. The rotating shaft of the motor 1022 is coupled to a belt 1024 and to a side, heel wheel 1026 of the footwear 1028 in order to provide electrically powered rolling of the wheel 1026. In an alternative embodiment, a sprag clutch may be used at the coupling of the rotating shaft of the motor 1022 and the belt 1024 to allow the wheel to roll freely without the resistance of the motor windings when the motor is not energized. The motorized heeling apparatus 1020 will also include a throttle, preferably a wireless throttle, and an electrical source, such as a battery source.

Figure 24:
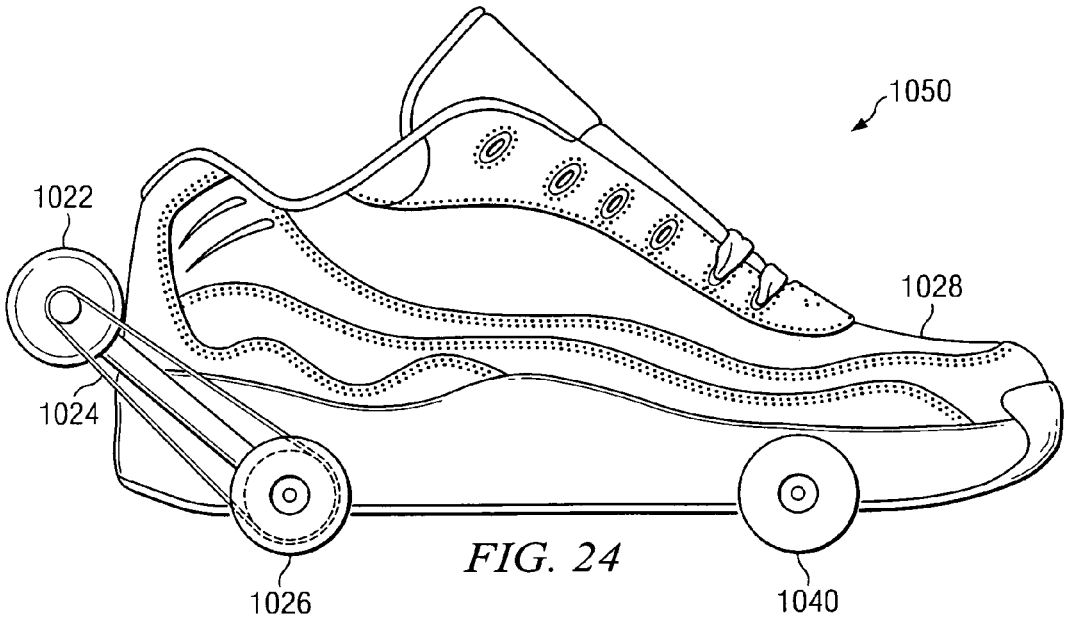
FIG. 24 is a side perspective view that illustrates the motorized heeling apparatus of FIG. 23 with a passive front wheel to implement a motorized footwear according to an aspect of the present invention.

FIG. 24 is a side perspective view that illustrates the motorized heeling apparatus 1020 of FIG. 23 with a passive front wheel 1040 to implement a motorized footwear 1050, according to an aspect of the present invention. This provide motorized wheeled footwear to be used on many available surfaces.

Figure 25A:
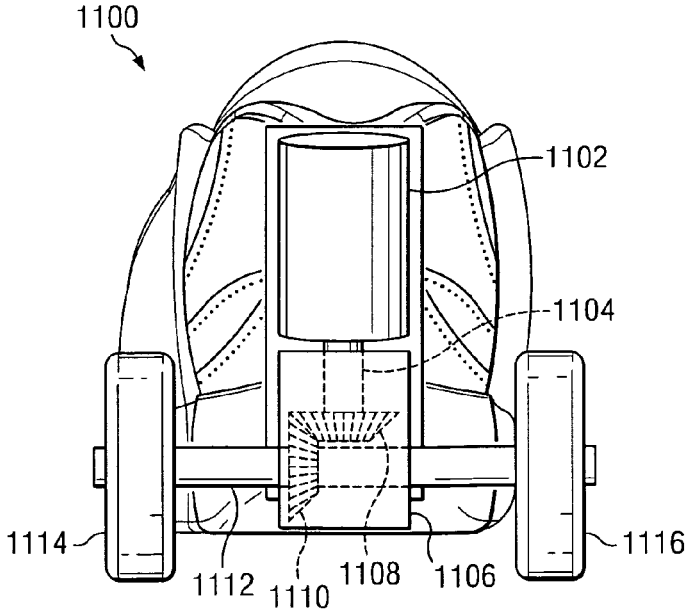
FIG. 25A-C includes a back perspective view that illustrates a motorized heeling apparatus and a coupling (which includes a gearing or transmission arrangement) to rotate two wheels adjacent the heel of the footwear in FIG. 25A, according to another aspect of the present invention, a back view that illustrates a side mount motor to rotate one wheel in FIG. 25B, and a sprag clutch and axle arrangement or assembly in FIG. 25C that may be used in a preferred embodiment of the motorized heeling apparatus.

FIG. 25A is a back perspective view that illustrates a motorized heeling apparatus 1100, which includes a motor 1102 with a rotating shaft 1104 that is used to provide rotational energy to a shaft 1112 through a gearing arrangement 1106 that includes a gear 1108 of the shaft 1104 and a gear 1110 of the shaft 1112. In this way, two side, heel wheels 1114 and 1116 may be driven by the motor 1102. If a sprag clutch is used wheels 1114 and 1116, the wheels may roll forward when the motor 1102 is not providing power, and will also roll forward when turned by the shaft 1112 when electric motor power is applied.

Figure 25B:
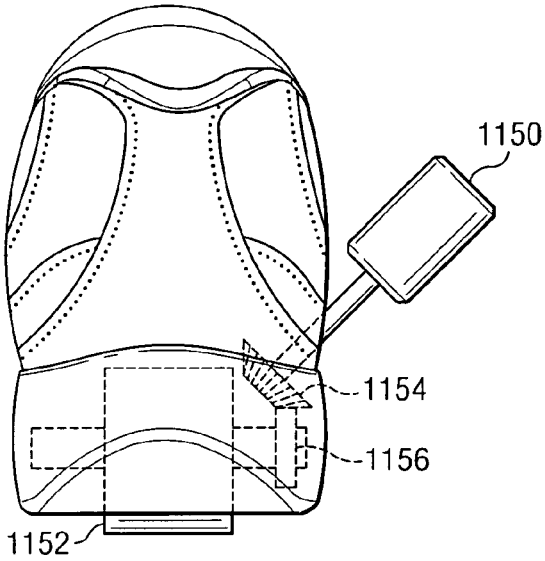

FIG. 25B is a back, perspective view that illustrates a side mount motor 1150 to rotate one wheel 1152 in an opening in the heel of the footwear using the gears 1154 and 1156, which in combination with the footwear provides a motorized heeling apparatus.

Figure 25C:
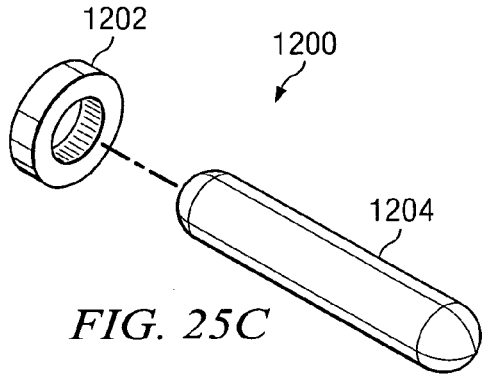

FIG. 25C illustrates a sprag clutch 1202 and an axle 1204 arrangement or assembly 1200 that may be used in a preferred embodiment of the motorized heeling apparatus, including motorized footwear, and motorized transportation apparatus.

Figure 26:
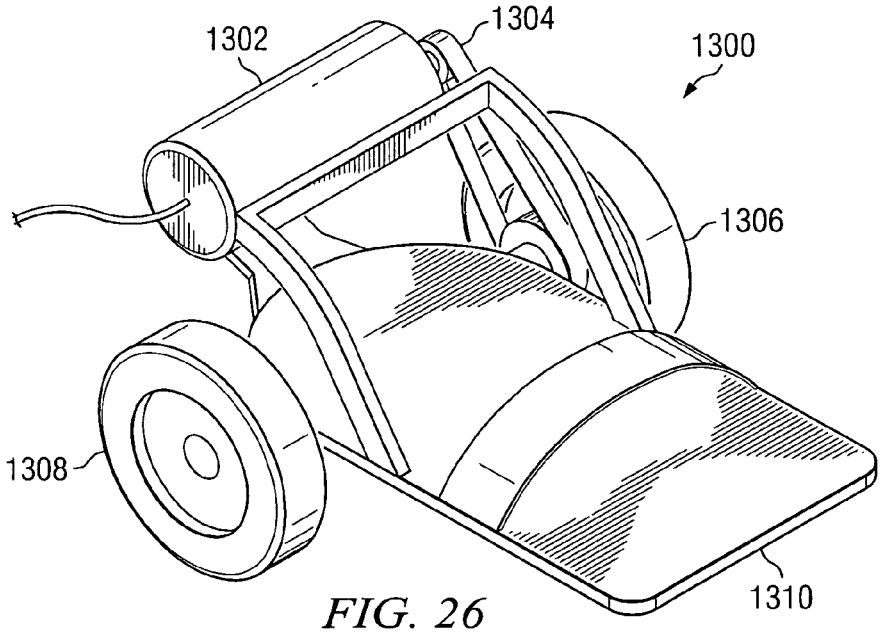
FIG. 26 is a side perspective view that illustrates a motorized heel bracket to receive the heel of a footwear, and that includes a transverse, back mounted dc brush motor with a band or belt coupling to rotate one wheel adjacent a heel plate, and a passive wheel opposite the motor (or belt) driven wheel, according to yet another aspect of the present invention.

FIG. 26 is a side perspective view that illustrates a motorized heel bracket 1300 to receive the heel of a footwear, and that includes a transverse, back mounted dc brush motor 1302 with a band or belt coupling 1304 to rotate one wheel 1306 adjacent a heel plate 1310, and a passive wheel 1308 opposite the motor (or belt) driven wheel 1306, according to yet another aspect of the present invention.

Figure 27A:
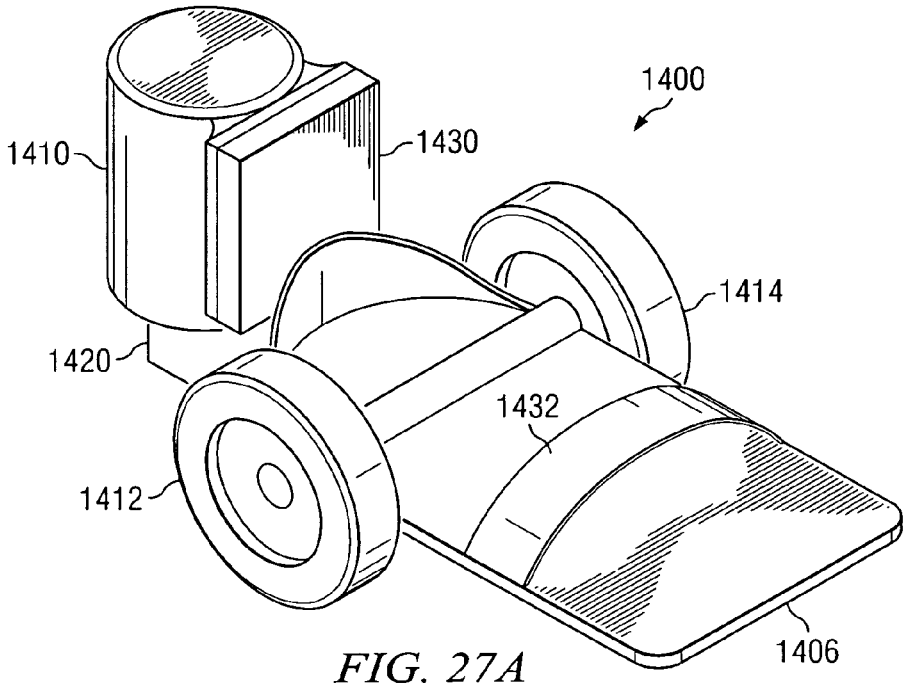
FIG. 27A-C are various views of a motorized heel bracket, including a wireless throttle of FIG. 27C, and that illustrates a heel bracket having a back mounted motor and a transmission (or gear arrangement) to power two wheels located on each side of a heel bracket, according to yet another aspect of the present invention.
Figure 27B:
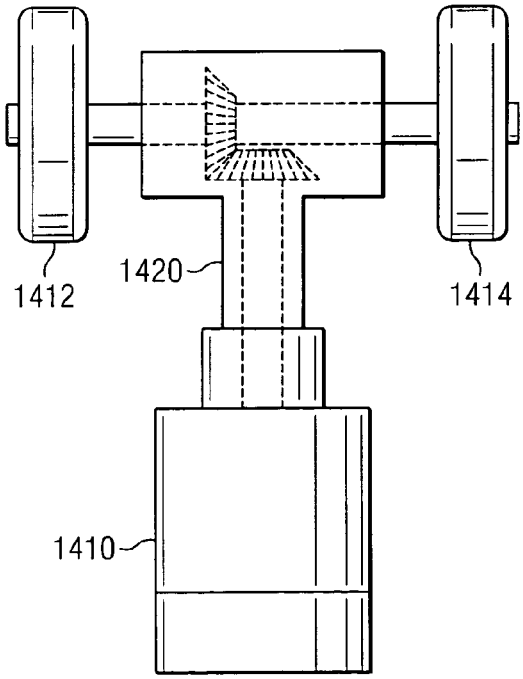
Figure 27C:
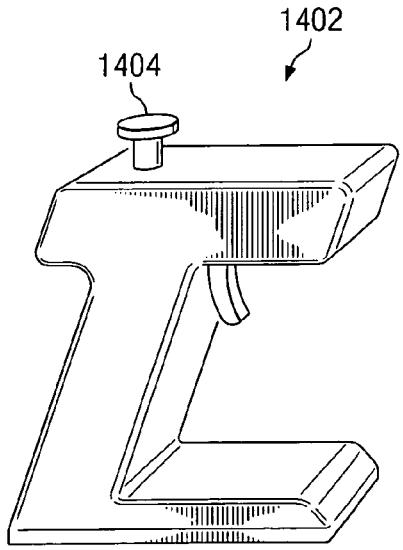

FIG. 27A-C are various views of a motorized heel bracket 1400, including a wireless throttle 1402 of FIG. 27C that includes an antenna 1404 and a transmitter within. The motorized heel bracket 1400 includes a heel plate 1406 having a back mounted motor 1410 and a transmission (or gear arrangement) 1420 to power two wheels, wheels 1412 and 1414, located on each side of the heel plate 1406, according to yet another aspect of the present invention. A series of batteries 1430 are shown positioned adjacent the motor, and a strap 1432 to hold a foot or footwear to the heel bracket is shown. In other embodiments, a connector, such as a male/female connector or a friction fit connector, may be used to connect footwear to the motorized heel bracket 1400.

Figure 28:
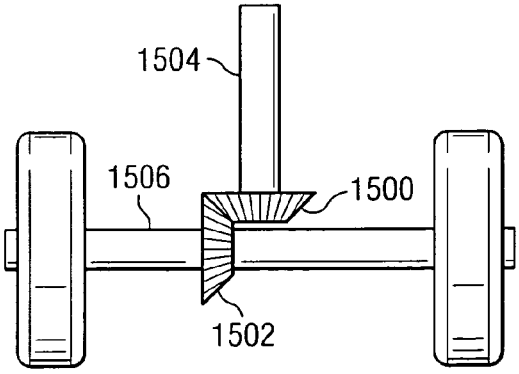
FIG. 28 is a block diagram that illustrates a coupling or gear arrangement that may be utilized in certain implementation of the present invention.

FIG. 28 is a block diagram that illustrates a coupling or gear arrangement that may be utilized in certain implementation of the present invention. A gear 1500 on a rotating shaft 1504 may be used to rotate a shaft 1506 to turn the two wheels as shown.

Figure 29:
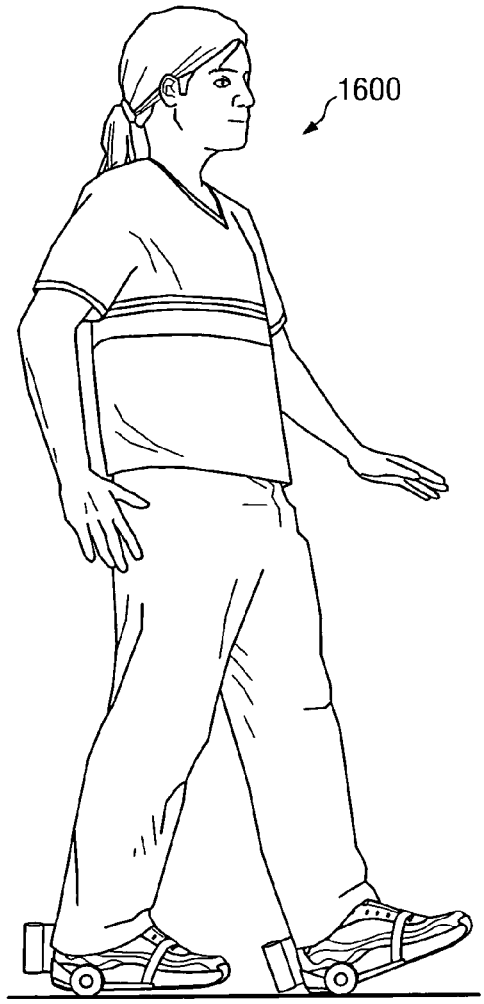
FIG. 29 is similar to FIG. 14, and is a perspective view that illustrates the use of motorized heel brackets on both feet (although in a preferred embodiment only one motorized heel bracket is needed while the other foot may use any wheeled footwear to provide passive rolling)

FIG. 29 is similar to FIG. 14, and is a perspective view that illustrates the use of motorized heel brackets on both feet (although in a preferred embodiment only one motorized heel bracket is needed while the other foot may use any wheeled footwear to provide passive rolling, such as a heeling apparatus). The skater or heeler 1600 is shown in the "heeling" position with one foot in front of the other.

Figure 30A:
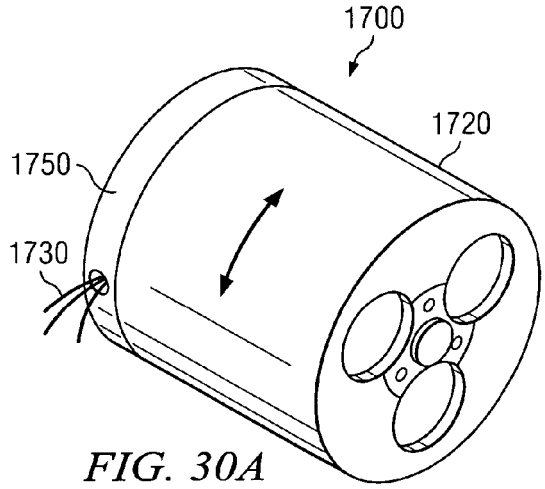
FIG. 30A-C are a perspective views that illustrate a motorized wheel assembly, which includes, in this embodiment, a brushless dc motor that includes a cylindrical portion of the motor casing or housing that rotates, and a wheel mounted around the cylindrical portion of the motor housing to serve as a wheel in a motorized apparatus.
Figure 30B:
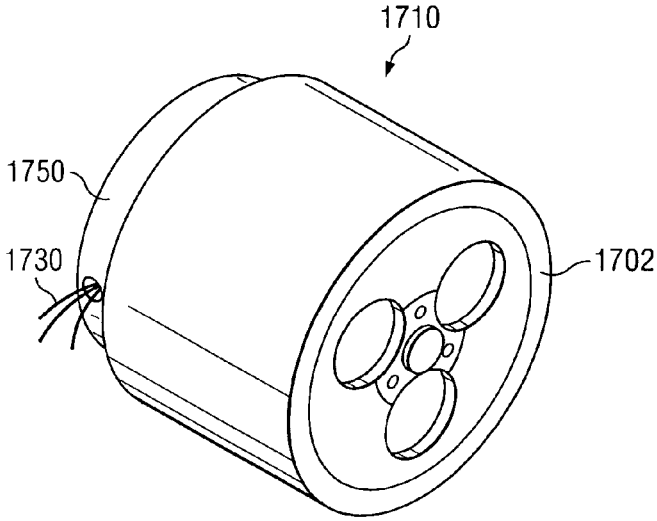
Figure 30C:
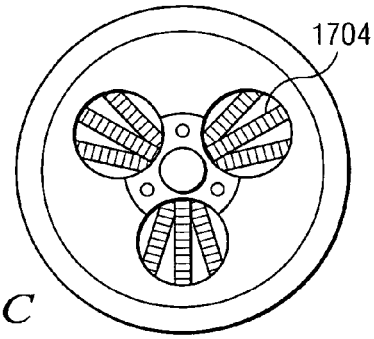

FIG. 30A-C are a perspective views that illustrate a motorized wheel assembly 1710, which includes, in this embodiment, a brushless dc motor 1700 that includes a cylindrical portion of the motor casing or housing 1720 that rotates, and a wheel 1702 mounted around the cylindrical portion of the motor housing 1720 to serve as a wheel in a motorized apparatus. FIG. 30C illustrates a side view of the motor 1700, and shows various motor winding, such as windings 1704 that can be viewed through the openings in the rotatable housing 1720. Motor power and control wiring 1730 are shown exiting the motor 1700 at a portion 1750 of the housing that does not rotate. The wheel 1702 is preferably provided as a urethane, but may use any of a variety of materials.

One known manufacturer of a motor 1700 that may be used in the motorized wheel assembly 1710 is "MODEL MOTORS," which makes dc electric motors that are brushless, and a portion of the casing or housing surrounding the coils of the motor have a cylindrical shape, like a roller, and rotate when electrical power is provided to the motor.

This type of arrangement provides a profusion of potential applications that uses the rotatable motor housing as a wheel.

Figure 31A:
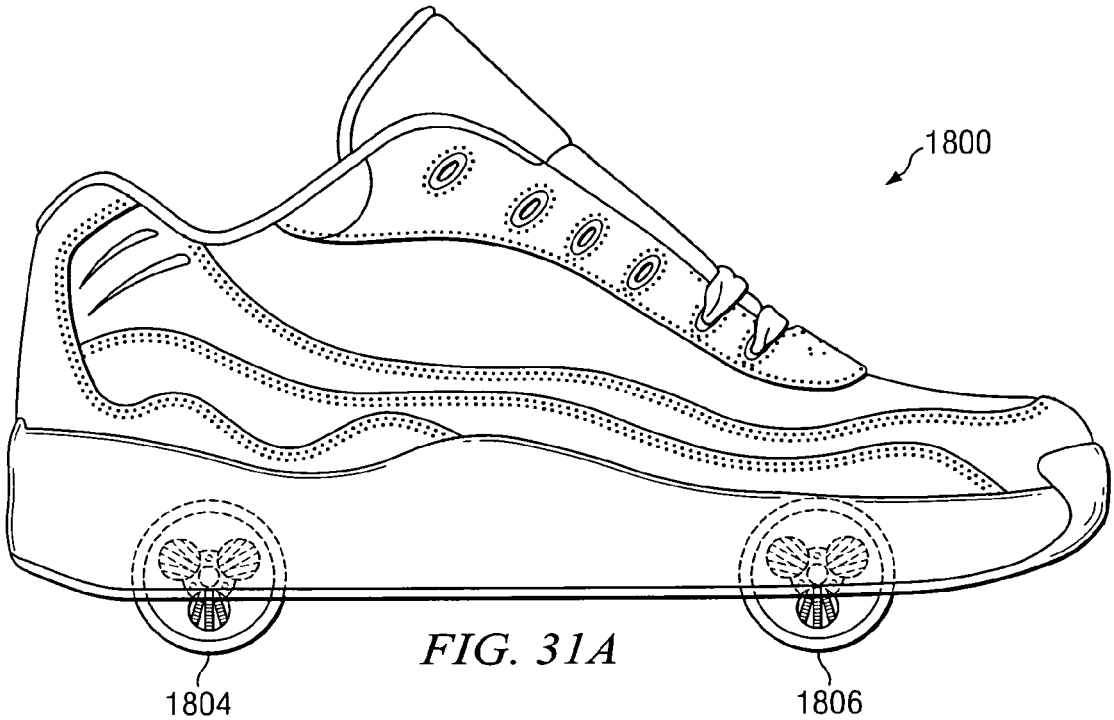
FIGS. 31A and 31B are side perspective views that illustrate a motorized wheel assembly used in a motorized footwear using two motorized wheel assemblies and one motorized wheel assembly.
Figure 31B:
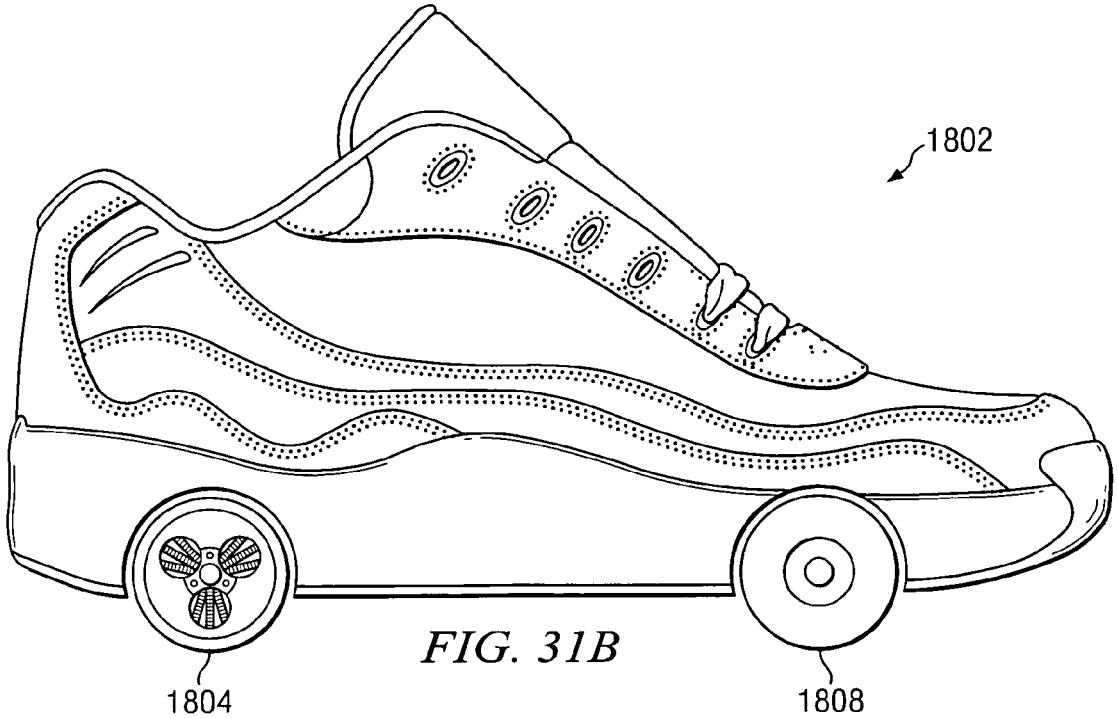

FIG. 31A and 31B are side perspective views that illustrate a motorized wheel assembly 1804 used in a motorized footwear 1800, which also uses a motorized wheel assembly 1806, using two motorized wheel assemblies, and a motorized footwear 1802 using only the motorized wheel assembly 1804 and a passive roller or wheel 1808. The convenience of having the motor integrated into one or more wheels provides numerous advantages as mentioned previously.

Figure 32:
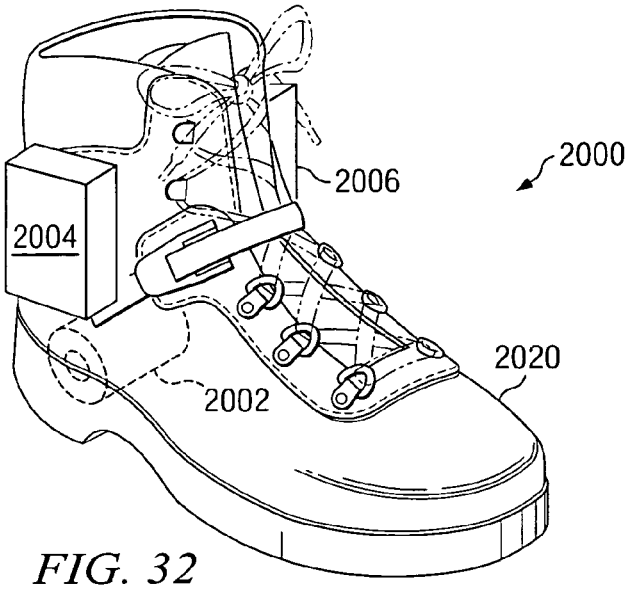
FIG. 32 is a perspective view that illustrates a motorized heeling apparatus using the motorized wheel assembly, and including batteries and throttle circuitry all on one shoe or boot, according to an aspect of the present invention.

FIG. 32 is a perspective view that illustrates a motorized heeling apparatus 2000 using a motorized wheel assembly 2002 in an opening in the bottom surface of a heel portion of the footwear 2020. Batteries 2004 and a throttle circuitry 2006 are shown stored and conveniently packaged all on one shoe or boot 2020, according to an aspect of the present invention.

Figure 33:
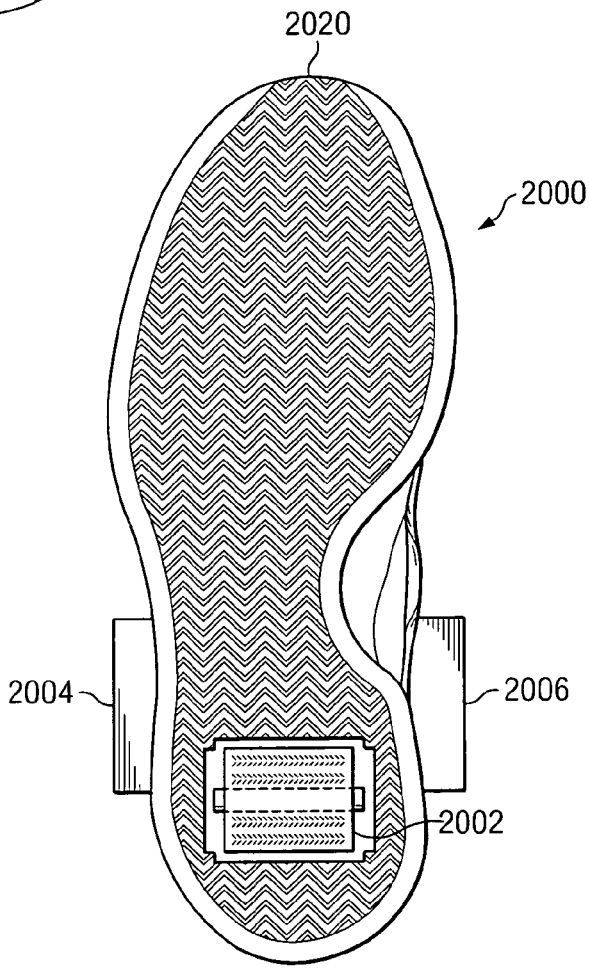
FIG. 33 is a bottom view of the motorized heeling apparatus of FIG. 32 that includes the bottom of the sole and the motorized wheel assembly residing in an opening in the bottom surface of the heel portion of the sole of the boot.
Figure 34A:
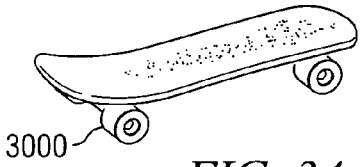
FIG. 34A-F are perspective views that illustrate various motorized personal transportation apparatus that each use a motorized wheel assembly, according to various aspects of the present invention.
Figure 34B:
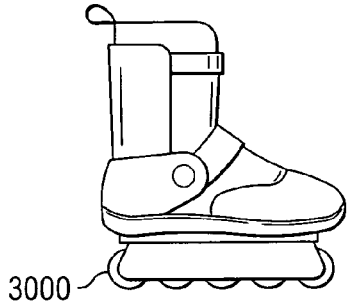
Figure 34C:
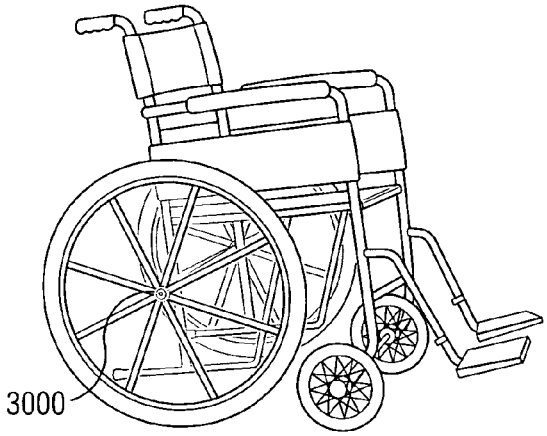
Figure 34D:
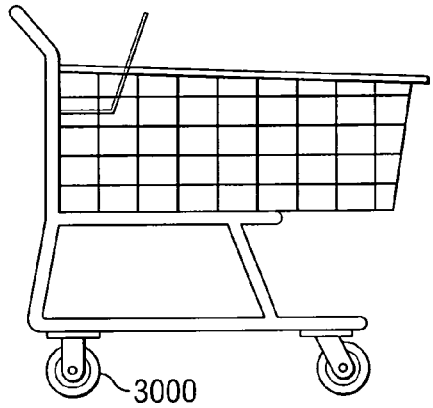
Figure 34E:
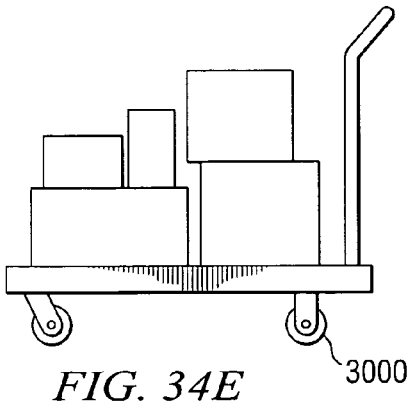
Figure 34F:
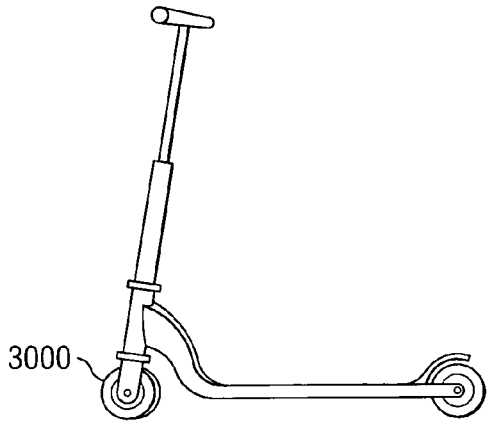

FIG. 33 is a bottom view of the motorized heeling apparatus 2000 of FIG. 32 that includes the bottom of the sole of the footwear 2020 and the motorized wheel assembly 2002 residing in an opening in the bottom surface of the heel portion of the sole of the boot 2020.

FIG. 34A-F are perspective views that illustrate various motorized personal transportation apparatus that each use a motorized wheel assembly 3000, according to various aspects of the present invention.

Thus, it is apparent that there has been provided, in accordance with the present invention, a motorized personal transportation apparatus and method, including a motorized heeling apparatus, including motorized footwear, a motorized heel bracket and a motorized wheel assembly, that satisfies one or more of the advantages set forth above. Although the preferred embodiment has been described in detail, it should be understood that various changes, substitutions, and alterations can be made herein without departing from the scope of the present invention, even if all of the advantages and benefits identified above are not present. For example, the various embodiments and examples shown in the drawings and descriptions provided herein illustrate that the present invention may be implemented and embodied in numerous different ways that still fall within the scope of the present invention, whether expressly shown herein or not. For example, the various elements or components may be combined or integrated in another system or certain features may not be implemented. Also, the techniques, systems, sub-systems, and methods described and illustrated in the preferred embodiment as discrete or separate may be combined or integrated with other systems, designs, techniques, or methods without departing from the scope of the present invention. For example, the electric motor and its battery may be placed in a variety of locations, including locations not specifically discussed herein. Other examples of changes, substitutions, and alterations are readily ascertainable by one skilled in the art and could be made without departing from the spirit and scope of the present invention.

What is claimed is:

1. A motorized footwear for use on a surface, the motorized footwear comprising:

a motorized wheel assembly operable to propel the motorized footwear in a forward direction when electrical power is provided, and operable to roll in a forward direction when power is not provided, the motorized wheel assembly includes:

an electric motor that includes a housing that at least partially surrounds a motor coil, wherein the electric motor is operable to rotate at least a portion of the housing that is provided in a generally cylindrical shape in a forward rotational direction around the motor coil in response to applying electrical power to the electric motor, a wheel positioned around the at least a portion of the housing that is provided in a generally cylindrical shape, and operable to rotate with the housing in the forward rotational direction when electrical power is applied to the electric motor, and wherein the wheel and the housing that is a generally cylindrical shape are operable to serve as a roller to roll on the surface;

a battery operable to provide electrical power to the electric motor of the motorized wheel assembly;

a throttle operable to control the speed of the rotation of the roller by controlling the amount of electrical power provided to the electric motor of the motorized wheel assembly;

a footwear that includes a sole with a forefoot portion, an arch portion and a heel portion, the heel portion having a bottom surface and an opening formed therein; and wherein the roller is positioned adjacent and within the opening in the bottom surface of the heel portion of the sole such that, in use, in an electric powered rolling mode, the roller provides contact with the surface to allow a user to roll in the forward direction on the surface while electrical power is applied to the electric motor to rotate the roller in the forward rotational direction, and wherein the roller, in a passive rolling mode, provides contact with the surface to allow the user to impart roll to the roller in the forward rotational direction on the surface while electrical power is not applied to the electric motor.

2. The motorized footwear of claim 1, further comprising:

a second motorized wheel assembly that includes a second wheel positioned around at least a portion of a second motor housing, of a second electrical motor, that is provided in a generally cylindrical shape, and operable to rotate with the second motor housing in the forward rotational direction when electrical power is applied to the second electric motor, and wherein the second wheel and the second motor housing are operable to serve as a second roller to roll on the surface both when electrical power is applied to the second electric motor and when electrical power is not applied to the second electric motor; and wherein the second roller is positioned adjacent and within an opening in the bottom portion of the forefoot portion of the sole such that, in use, in an electric powered rolling mode, the second roller provides contact with the surface to allow the user to roll in the forward direction on the surface while the second electric motor is engaged to rotate the second roller in the forward rotational direction.

3. The motorized footwear of claim 1, further comprising:

a second roller positioned adjacent and within an opening in a bottom surface of the forefoot portion of the sole of the footwear, and wherein the second roller is operable to rotate in the forward rotational direction to allow the user to roll in the forward direction on the surface.

4. The motorized footwear of claim 1, wherein the wheel contains urethane.

5. The motorized wheel assembly of claim 1, wherein the wheel contains plastic.

6. The motorized wheel assembly of claim 1, wherein the wheel contains rubber.

7. The motorized wheel assembly of claim 1, wherein the electric motor is a brushless dc motor.

* * * * *

UNITED STATES PATENT AND TRADEMARK OFFICE

CERTIFICATE OF CORRECTION

PATENT NO. : 7,610,972 B2
APPLICATION NO. : 11/198673
DATED : November 3, 2009
INVENTOR(S) : Adams et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 756 days.

Signed and Sealed this

Twelfth Day of October, 2010

David J. Kappos

David J. Kappos
*Director of the United States Patent and Trademark Office*